US008576042B2

(12) United States Patent
Ullermann

(10) Patent No.: US 8,576,042 B2
(45) Date of Patent: Nov. 5, 2013

(54) MINIATURE CIRCUIT BREAKER

(75) Inventor: Wolfgang Ullermann, Schwabach (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 163 days.

(21) Appl. No.: 13/074,336

(22) Filed: Mar. 29, 2011

(65) Prior Publication Data

US 2011/0220475 A1 Sep. 15, 2011

Related U.S. Application Data

(63) Continuation of application No. PCT/EP2009/005586, filed on Aug. 1, 2009.

(30) Foreign Application Priority Data

Sep. 29, 2008 (DE) ..... 10 2008 049 507

(51) Int. Cl.

| | |
|---|---|
| ***H01H 37/54*** | (2006.01) |
| ***H01H 37/00*** | (2006.01) |
| ***H01H 61/00*** | (2006.01) |
| ***H01H 13/14*** | (2006.01) |

(52) U.S. Cl.

USPC ..... 337/365; 337/380; 337/390; 337/333; 337/89; 337/66; 337/112; 337/36; 29/622; 200/314; 200/520

(58) Field of Classification Search

USPC ..... 337/2, 36, 365, 380, 390, 333, 89, 66, 337/112; 29/622; 200/314, 520

See application file for complete search history.

(56) References Cited

U.S. PATENT DOCUMENTS

| | | | | | |
|---|---|---|---|---|---|
| 3,213,246 | A | * | 10/1965 | Duval | 337/112 |
| 3,430,177 | A | * | 2/1969 | Audette | 337/365 |
| 3,443,259 | A | * | 5/1969 | Wehl et al. | 337/89 |
| 3,453,577 | A | * | 7/1969 | Entremont | 337/89 |
| 3,972,016 | A | * | 7/1976 | Schmitt | 337/354 |

(Continued)

FOREIGN PATENT DOCUMENTS

| | | |
|---|---|---|
| DE | 35 26 785 C1 | 7/1986 |
| EP | 1 278 226 B1 | 1/2003 |

(Continued)

OTHER PUBLICATIONS

International Search Report of PCT/EP2009/005586, Dated Oct. 29, 2009.

*Primary Examiner* — Bradley Thomas
(74) *Attorney, Agent, or Firm* — Laurence A. Greenberg; Werner H. Stemer; Ralph E. Locher

(57) ABSTRACT

A miniature circuit breaker has a housing formed of a housing base of insulating material and a pot-like housing cover, which is or can be positioned onto the housing base. Two elongate and flat contact arms are partially embedded in the housing base parallel with respect to one another in terms of their longitudinal direction. A fixed contact is arranged at an inner end of a first one of the contact arms. A bimetallic snap-action disk with a free end, forming or bearing a moving contact, is fitted at an inner end of the second contact arm at a fastening point. The fastening point, the moving contact and the fixed contact are in this case on an axis which is parallel to the longitudinal direction of the contact arms.

25 Claims, 24 Drawing Sheets

(56) References Cited

U.S. PATENT DOCUMENTS

| | | | | | |
|---|---|---|---|---|---|
| 4,157,525 | A | * | 6/1979 | Grable | 337/343 |
| 4,317,097 | A | * | 2/1982 | Hofsass | 337/89 |
| 4,363,016 | A | | 12/1982 | Unger | |
| 4,496,928 | A | * | 1/1985 | Hollweck | 337/94 |
| 4,667,175 | A | | 5/1987 | Sell | |
| 4,755,787 | A | * | 7/1988 | Wehl | 337/372 |
| 5,153,552 | A | * | 10/1992 | Krasser | 337/66 |
| 5,248,954 | A | | 9/1993 | Chiang | |
| 5,367,279 | A | * | 11/1994 | Sakai | 337/104 |
| 5,513,063 | A | | 4/1996 | Wu | |
| 5,585,774 | A | | 12/1996 | Bennett | |
| 5,607,610 | A | * | 3/1997 | Furukawa | 219/505 |
| 5,847,637 | A | * | 12/1998 | Takeda et al. | 337/344 |
| 5,939,970 | A | * | 8/1999 | Tsuji et al. | 337/343 |
| 6,005,471 | A | * | 12/1999 | Higashikata et al. | 337/347 |
| 6,097,274 | A | * | 8/2000 | Hofsass | 337/362 |
| 6,144,541 | A | * | 11/2000 | Kato et al. | 361/105 |
| 6,191,680 | B1 | * | 2/2001 | Hofsass | 337/362 |
| 6,249,210 | B1 | * | 6/2001 | Hofsass | 337/324 |
| 6,300,860 | B1 | * | 10/2001 | Hofsass | 337/377 |
| 6,396,381 | B1 | * | 5/2002 | Takeda | 337/377 |
| 6,414,285 | B1 | * | 7/2002 | Takeda | 219/507 |
| 6,590,489 | B1 | | 7/2003 | Ullermann et al. | |
| 6,633,222 | B2 | * | 10/2003 | Nagai et al. | 337/365 |
| 6,707,368 | B2 | | 3/2004 | Alfaro et al. | |
| 8,237,536 | B2 | * | 8/2012 | Takeda | 337/365 |
| 2002/0130755 | A1 | * | 9/2002 | Takasugi et al. | 337/333 |
| 2006/0132279 | A1 | * | 6/2006 | Ecker et al. | 337/229 |
| 2006/0186984 | A1 | * | 8/2006 | Ullermann | 337/14 |
| 2007/0296540 | A1 | * | 12/2007 | Takeda | 337/380 |

FOREIGN PATENT DOCUMENTS

| | | | |
|---|---|---|---|
| RU | 2091884 | C1 | 9/1997 |
| RU | 2096853 | C1 | 11/1997 |
| RU | 2165112 | C2 | 4/2001 |

* cited by examiner

MINIATURE CIRCUIT BREAKER

CROSS-REFERENCE TO RELATED APPLICATION

This application is a continuation, under 35 U.S.C. §120, of copending international application No. PCT/EP2009/005586, filed Aug. 1, 2009, which designated the United States; this application also claims the priority, under 35 U.S.C. §119, of German patent application No. DE 10 2008 049 507.7, filed Sep. 29, 2008; the prior applications are herewith incorporated by reference in their entirety.

BACKGROUND OF THE INVENTION

Field of the Invention

The invention relates to a miniature circuit breaker, as is used, for example, in the field of automotive electric systems. Such circuit breakers are used increasingly to replace the flat plug-type fuses previously used as a standard in the automotive sector.

The flat plug-type fuses used in the automotive sector are standardized in terms of their geometric dimensions. The standard which is still valid in Germany in this regard is DIN 72581-3. The international standard ISO 8820 is at present being prepared for this field. In the last-mentioned standard, three sizes of flat plug-type fuses are defined, namely "Type C (medium)", "Type E (high current)" and "Type F (miniature)".

Circuit breakers of the above-mentioned type are generally based on the standards developed for flat plug-type fuses in order to ensure compatibility of the circuit breakers with plug-type bases for flat plug-type fuses. In general, here, a circuit breaker which is compatible in terms of its geometrical dimensions with a female plug-type connector for a flat plug-type fuse, in particular a flat plug-type fuse of the (smallest) Type F in accordance with ISO 8820, is referred to as a miniature circuit breaker. Such circuit breakers are marketed, for example, by the company Cooper Bussmann under the designation "Series 21 X mini circuit breaker".

Circuit breakers of the abovementioned type generally comprise, as tripping mechanism, a bimetallic snap-action disk, which changes between two positions of curvature suddenly and reversibly depending on the temperature. The bimetallic snap-action disk is fixedly connected to a bimetallic contact arm at one or more fastening points. That free end of the bimetallic snap-action disk which is remote from the fastening point(s) forms or bears a moving contact. The bimetallic snap-action disk is in this case arranged in such a way that the moving contact bears against a corresponding fixed contact of a fixed contact arm as long as the temperature prevailing in the circuit breaker falls below a temperature threshold value which is predetermined according to the construction. In this case, an electrically conductive path is thus closed between the bimetallic contact and the fixed contact via the bimetallic snap-action disk. As soon as the temperature prevailing in the circuit breaker exceeds the temperature threshold value as a result of an excess current, the bimetallic snap-action disk changes shape suddenly as a result of which the moving contact is lifted up from the fixed contact and the current path is thus disconnected.

In the case of simple circuit breakers of the abovementioned type, the current path is closed or interrupted exclusively by the temperature-related change in shape of the bimetallic snap-action disk. Such circuit breakers function intermittently when an overload condition is still existing, i.e. for example in the case of a short circuit which is still existing even after the circuit breaker has been tripped for the first time, especially since the circuit breaker cools down gradually after tripping, as a result of which the bimetallic snap-action disk again closes the current path and therefore initiates the tripping cycle of the circuit breaker again.

Circuit breakers of the abovementioned type with a more complex configuration contain, in addition to the bimetallic snap-action disk, a disconnecting mechanism, which slides between the moving contact and the fixed contact when the circuit breaker is tripped, with the result that the circuit remains interrupted even once the bimetallic snap-action disk has snapped back. Such disconnecting mechanisms are described for comparatively large circuit breakers (for example compatible with ISO 8820 Type C), for example, in commonly assigned U.S. Pat. No. 4,667,175 and its counterpart German patent DE 35 26 785 C1, and also in U.S. Pat. No. 6,707,368 B2 and its counterpart European patent EP 1 278 226 B1.

A circuit breaker of the generic type is known from U.S. Pat. No. 6,144,541. The circuit breaker comprises a housing with a housing base consisting of insulating material and a pot-like housing cover which is positioned onto the housing base. Two elongate and flat contact arms are embedded partially in the housing base, parallel to one another in terms of their longitudinal direction. A fixed contact is arranged at an inner end of a first one of the contact arms. A bimetallic snap-action disk with a free end which forms or bears a moving contact, is fitted at an inner end of the second contact arm at a fastening point with the result that the fastening point and the moving contact lie on an axis which is parallel to the longitudinal direction of the contact arms. Further circuit breakers in which the fastening point of the bimetallic snap-action disk and the moving contact likewise lie on an axis parallel to the longitudinal direction of the contact arms are known from U.S. Pat. Nos. 4,363,016 and 5,513,063 and 5,248,954.

SUMMARY OF THE INVENTION

It is accordingly an object of the invention to provide a miniature circuit breaker, which overcomes a variety of disadvantages of the heretofore-known devices and methods of this general type and which provides for a functionally reliable circuit breaker that, in particular, can be produced easily and that is particularly suitable for miniaturization.

With the foregoing and other objects in view there is provided, in accordance with the invention, a miniature circuit breaker, comprising:

a housing formed with a housing base of insulating material and a pot-shaped housing cover configured for placement on said housing base;

two flat, elongate contact arms partially embedded in said housing base and extending parallel to one another in a longitudinal direction thereof, said contact arms including a first contact arm having an inner end and a second contact arm having an inner end with a fastening point;

a fixed contact disposed at said inner end of said first contact arm;

a bimetallic snap-action disk with a moving contact at a free end thereof, said snap-action disk being mounted to said fastening point at said inner end of said second contact arm, said fastening point and said moving contact lying on an axis extending parallel to the longitudinal direction of said contact arms;

said inner end of said second contact arm being bent backwards between said housing base and said fastening point, about an axis extending transversely to the longitudinal direction of said contact arms, causing said second contact arm to extend with an inclination relative to a central plane of the circuit breaker.

In other words, the objects of the invention are achieved with a circuit breaker that has a housing, which is formed from a housing base consisting of insulating material and a housing cover which is or can be positioned onto the housing base. In this case, the housing cover is in the form of a pot and therefore, at least substantially, closed on all five sides facing away from the housing base. Two elongate and flat contact arms are embedded partially in the housing base, parallel to one another in terms of their longitudinal direction. In this case, a fixed contact is arranged at an inner end of a first one of the two contact arms. A fastening point is arranged at an inner end of the second contact arm with a bimetallic snap-action disk being fitted to said fastening point, wherein the bimetallic snap-action disk forms a moving contact (or carries a separate moving contact) at its free end.

In this case, the bimetallic snap-action disk is arranged in the housing in such a way that the fastening point and the moving contact lie on a common axis, which is parallel to the longitudinal extent of the contact arms.

It has been shown that in particular the combination of the bimetallic snap-action disk aligned in the longitudinal direction with the pot-like housing cover is particularly advantageous for simple miniaturization of the circuit breaker. It is thus possible for particularly good use to be made of the installation space available for the bimetallic snap-action disk by virtue of the longitudinal position of said bimetallic snap-action disk. In particular, a bimetallic snap-action disk which is sufficiently long for an operationally safe switching response can be arranged in a particularly small installation area owing to the longitudinal position of the bimetallic snap-action disk. The use of a pot-like housing cover in this case enables particularly good accessibility of the electrical components, in particular the bimetallic snap-action disk, which considerably simplifies fitting thereof. The above-described construction principle has proved to be particularly advantageous for the construction of a circuit breaker with geometrical dimensions established according to ISO 8820 Type F (miniature).

In an advantageous configuration, the housing cover is an integral part, which likewise consists of insulating material, in particular a thermoplastic polymer.

By virtue of the housing formed completely from (electrical) insulating material, firstly the operational safety of the circuit breaker is increased, especially since the possibility of current emerging from the housing during faulty contact between the housing and an electrically conductive component of the circuit breaker and therefore the risk of short circuits and current loops via the housing is safely avoided. Secondly, the housing which consists completely of insulating material, in contrast to a wholly or partially metallic housing, has only very low thermal conductivity, as a result of which an improved response characteristic of the circuit breaker is achieved. Specifically, as a result of the reduced heat dissipation in the event of an overload, a comparatively low amount of heat loss needs to be generated in the circuit breaker in order to cause said circuit breaker to trip when using a conventional bimetallic snap-action disk. In addition, the cooling of the circuit breaker is slowed down. A simple intermittent circuit breaker of the type according to the invention therefore has a significantly longer tripping time than a comparable circuit breaker with a metallic housing, given the same environmental conditions. The life of the circuit breaker is thus extended and the risk of faulty operation as a result of a prematurely worn bimetallic snap-action disk is reduced.

Expediently, the inner end of the second contact arm (also referred to as bimetallic contact arm below) protrudes freely out of the housing base, with the result that the fastening point of the bimetallic snap-action disk is spaced apart from the housing base. This spacing is advantageously at least 2 mm, preferably between 3 mm and 5 mm and in particular approximately 4.5 mm (specifically 4.65 mm, for example).

Owing to the freestanding arrangement of the inner end of the second contact arm, this free end is particularly easily accessible, as a result of which the fitting of the bimetallic snap-action disk is simplified. In particular, the freestanding embodiment of the bimetallic contact arm makes it possible to use a particularly simple, precise and waste-free fitting method, in which the snap-action disk is first fastened on the bimetallic contact arm without any mechanical prestress with respect to the fixed contact and the prestress of the bimetallic snap-action disk with respect to the fixed contact is not set until a subsequent adjustment step by virtue of the inner end of the bimetallic contact arm being bent. In this case, the bending advantageously takes place about an axis which runs transversely with respect to the longitudinal direction of the contact arms. In the final fitted state of the circuit breaker, therefore, the inner end of the second contact arm is expediently bent back slightly about an axis which runs transversely with respect to the longitudinal direction of the contact arms between the housing base and the fastening point of the bimetallic snap-action disk, as a result of the adjustment step. Said inner end thus runs at an angle with respect to the plane which is defined by the adjoining region of the bimetallic contact arm. The above-described adjustment method is considered to be an invention in its own right.

As is conventional for circuit breakers of the abovementioned type, an outer end of each contact arm is guided outward out of the housing base so as to form a plug-type contact. In a similar way to the flat plug-type fuses, the two plug-type contacts are arranged in a common plane in a manner offset parallel at a distance. The common axis on which the fastening point of the bimetallic snap-action disk and the moving contact lie in accordance with the invention in this case expediently runs approximately centrally between the plug-type contacts.

In order to ensure a secure hold of the contact arms in the housing base, the contact arms are preferably embedded in a form-fitting manner in the housing base. The contact arms are in particular encapsulated by injection molding with the material of the housing base.

In a further advantageous variant of the circuit breaker, said circuit breaker is provided with a disconnecting element for electrically disconnecting the moving contact and the fixed contact. This disconnecting element comprises a disconnecting plate consisting of insulating material and a pushbutton, which protrudes out of the housing cover in the fitted state. The disconnecting plate is guided such that it can be shifted between a disconnected position, in which the disconnecting plate lies in insulating fashion between the moving contact and the fixed contact, and an enable position, in which the disconnecting plate enables contact to be made between the moving contact and the fixed contact. In this case, the disconnecting element is prestressed by a spring in the direction of the disconnected position, with the result that the disconnecting plate automatically assumes the disconnected position when the circuit breaker is tripped. The pushbutton is secondly configured such that the disconnecting plate can be reset to the enable position by manual pressure being applied to said pushbutton. In a comparatively simple embodiment, the disconnecting element is in particular an integral plastic injection-molded part. In this case, an extended position of the pushbutton always corresponds to the disconnected position of the disconnecting plate, while a depressed position of the pushbutton corresponds to the enable position.

The spring which prestresses the disconnecting element is expediently a helical compression spring. This helical compression spring is advantageously positioned onto a guide pin consisting of metal, which extends at least substantially over the entire spring length. This embodiment is based on the knowledge that the use of a helical compression spring is firstly desirable for reasons of a high degree of operational safety and a high degree of ease of fitting, but secondly that such helical compression springs are not guaranteed to be bend-free with the required miniaturization and therefore require a guide. It is known that the metallic guide pin passing through the spring forms an extremely space-saving, but nevertheless effective possible way of guiding the helical compression spring. In an embodiment which is particularly simple in terms of production, the guide pin is integral with one of the contact arms, in particular the fixed contact arm.

Preferably, the guide pin protrudes through the spring into a guide bore in the disconnecting element, in particular the pushbutton, wherein in particular the cross section of the guide bore is matched approximately to the cross section of the guide pin. Therefore, the guide pin is advantageously also used for directly guiding the disconnecting element. In addition or as an alternative to this, the disconnecting element is expediently (also) guided on a guide burr of the other contact arm, i.e. in particular of the bimetallic contact arm, in particular in the region of the disconnecting plate. For this purpose, the disconnecting element advantageously has a fork-like guide contour, which engages in a form-fitting manner around the guide burr. The "threading" of the guide contour onto the guide burr is in this case simplified expediently by virtue of the fact that the guide contour has two guide prongs, which are offset with respect to one another in the longitudinal direction. This embodiment also simplifies the production of the disconnecting element in the injection-molding process. The guide burr can alternatively also be formed on the base.

In a particularly advantageous variant of the circuit breaker, the pushbutton and the disconnecting plate are not integral, but are in the form of separate component parts which can be guided such that they can be shifted with respect to one another. In this case, the pushbutton has a driver, which is guided in such a way that it moves the disconnecting plate into the enable position when the pushbutton is depressed from its extended position into its depressed position, but that the driver is decoupled from the disconnecting plate when the depressed position of the pushbutton is reached. By virtue of the decoupling of the driver from the disconnecting plate, a so-called free tripping of the disconnecting plate is achieved. As a result of the free tripping, the disconnecting function of the disconnecting plate cannot be made so as to have no effect by virtue of the fact that the pushbutton is held permanently in its depressed state. Faulty operation of the circuit breaker by a pushbutton being depressed incorrectly or inadvertently is therefore ruled out.

In order to achieve the alternate coupling and decoupling of the driver with or from the disconnecting plate when the pushbutton is depressed and released in a simple manner which can be miniaturized relatively easily, the driver is preferably guided on a closed circular path, with the result that, when the pushbutton is depressed, it takes a different path than when the pushbutton springs back to the extended position. In particular, the driver is guided on a guide burr, which is formed integrally with one of the contact arms, in particular the bimetallic contact arm. In order to guide the driver on a closed circular path, the driver is preferably guided around this guide burr in the form of a ring.

In order to achieve circular guidance of the driver in a simple manner, said driver is expediently provided with two sliding faces, which are at an angle with respect to the shifting direction of the pushbutton and are in particular parallel to one another. These sliding faces are arranged with respect to the above-mentioned guide burr in such a way that the driver is deflected in each case onto another flat side of the contact arm when the pushbutton is depressed and when the pushbutton is extended.

The driver is connected to the pushbutton preferably in such a way that it can be deflected elastically. In particular, the driver is integrally connected to the pushbutton via a spring arm integrally formed thereon. When the pushbutton is depressed out of its extended position into its depressed position, the driver is preferably guided in such a way that it is located in an elastically deflected state. For simple and rapid decoupling of the driver from the disconnecting plate, in this case the contact arm is provided with a notch, by virtue of which the driver springs back into a rest position when the pushbutton has reached its depressed position, with the result that the driver is decoupled from the disconnecting plate quickly and safely.

The pushbutton advantageously also has a second driver. This second driver is arranged in such a way that it stops against the disconnecting plate in the extension direction of the pushbutton, with the result that the pushbutton is held in the depressed position by the disconnecting plate until the disconnecting plate is located in the enable position.

In an expedient configuration, with a separate embodiment for the disconnecting plate and the pushbutton, the two parts are prestressed separately by in each case one separate helical compression spring in the direction of the disconnected position of the disconnecting plate or the extended position of the pushbutton. Each of these two helical compression springs is in this case positioned on a separate guide pin of one of the contact arms in a sense of effective guidance which can be miniaturized easily. Preferably, the two helical compression springs are in this case guided on the same contact arm, in particular the fixed contact arm.

Other features which are considered as characteristic for the invention are set forth in the appended claims.

Although the invention is illustrated and described herein as embodied in a miniature circuit breaker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 11 shows, for example, an illustration as shown in FIG. 4 of the contact arms of the circuit breaker shown in FIG. 9 which are embedded in the housing base with the helical compression spring pushed on;

DETAILED DESCRIPTION OF THE INVENTION

Figure 1:
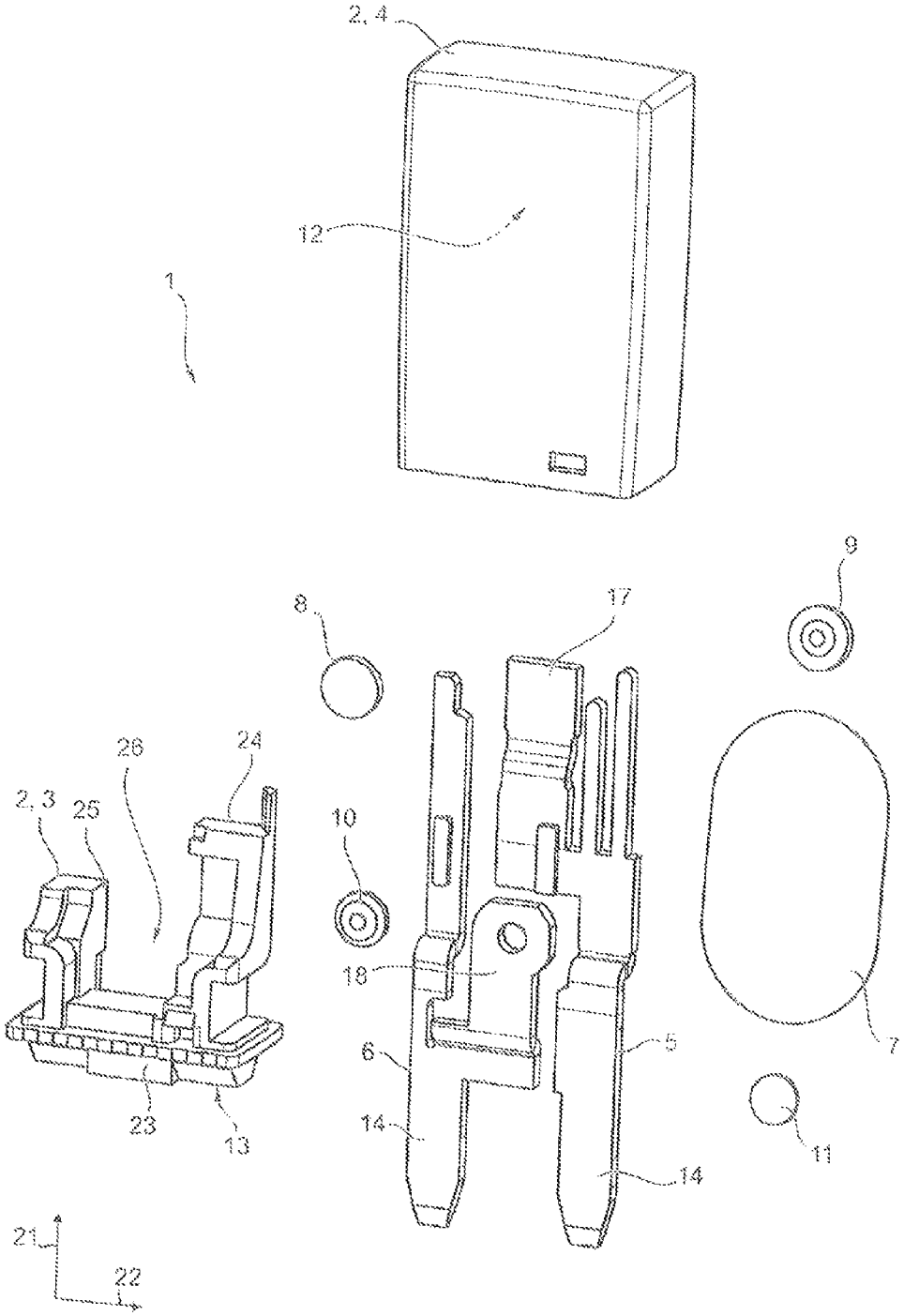
FIG. 1 shows an exploded illustration of a first variant of a circuit breaker with a housing formed from a housing base and a housing cover, two contact arms that are partially embedded in the housing base, and a bimetallic snap-action disk.

As required, mutually corresponding and functionally equivalent parts are identified with the same reference symbols throughout all of the figures.

A first variant of the circuit breaker is first illustrated in FIGS. 1 to 8. As can be seen in particular from the exploded illustration shown in FIG. 1, the circuit breaker 1 in this embodiment comprises a housing 2, which is formed from a housing base 3 and a housing cover 4. The circuit breaker 1 furthermore comprises a fixed contact arm 5, a bimetallic contact arm 6 and a bimetallic snap-action disk 7. The circuit breaker 1 also comprises a fixed contact 8 in the form of a welding platelet, a moving contact 9 in the form of a rivet and, for fastening the bimetallic snap-action disk 7, a further rivet 10 and a further welding platelet 11.

Figure 2:
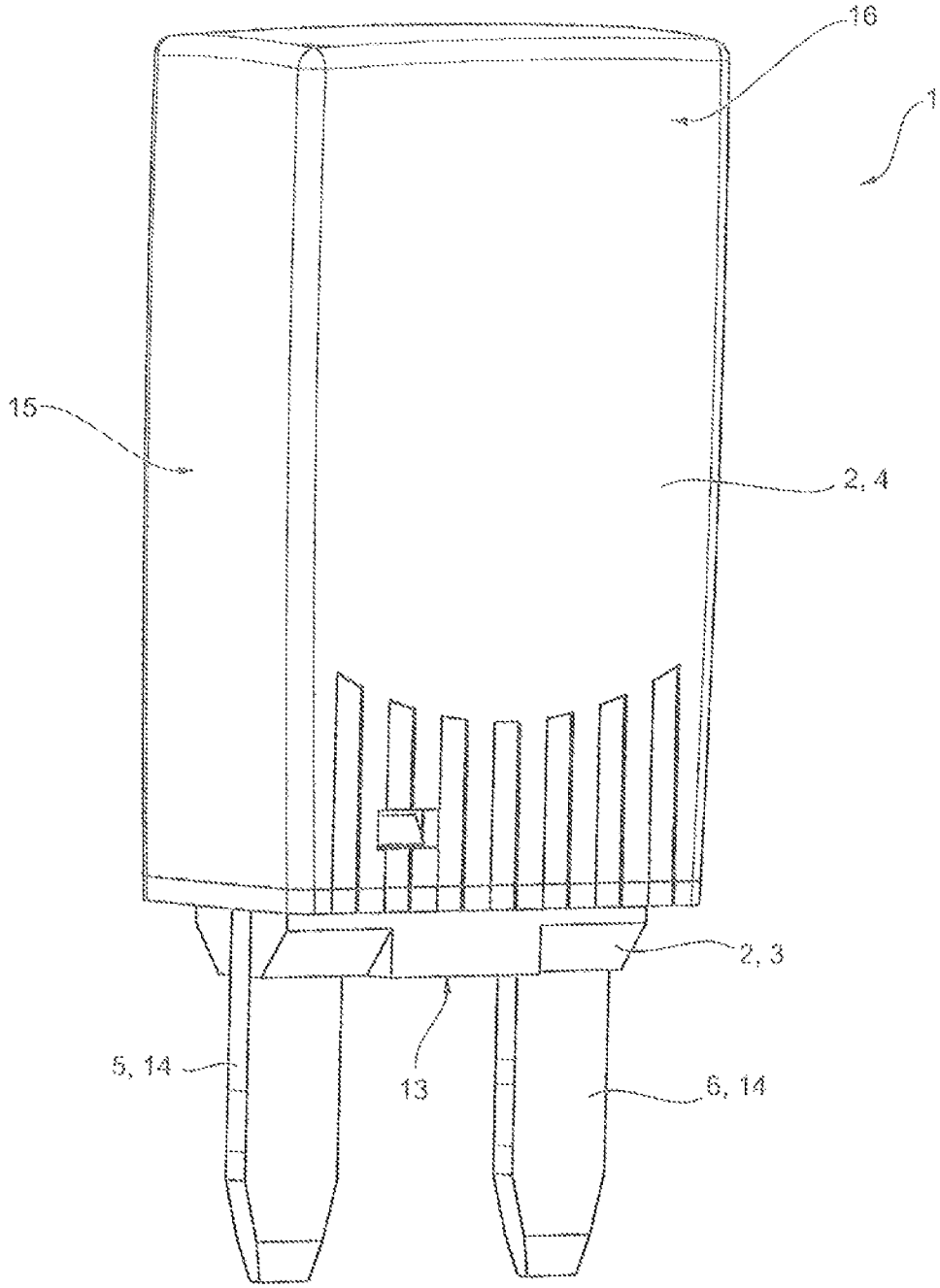
FIG. 2 shows a perspective illustration of the circuit breaker shown in FIG. 1 in the fitted state with the housing closed.

The housing base 3 and the housing cover 4 are manufactured from an electrically insulating material, namely a thermoplastic polymer. The integral housing cover 4 is in the form of a pot and therefore surrounds, with five closed walls, a volume which defines an interior 12 (indicated by a dashed reference arrow) of the circuit breaker 1. The housing cover 4 can be snapped onto the housing base 3 with its open side. FIG. 2 shows the circuit breaker 1 with the housing 2 closed, i.e. with the housing cover 4 positioned onto the housing base 3.

The contact arms 5 and 6 are bent and stamped parts consisting of sheet metal, in particular tin-plated brass, with a flat, rectangular cross section. The fixed contact arm 5 and the bimetallic contact arm 6 are embedded in a form-fitting manner in the housing base 3 by virtue of the contact arms 5 and 6 being encapsulated by injection molding with the material of the housing base 3 during production of the circuit breaker 1. In this case, the contact arms 5 and 6 protrude outward out of the housing base 3 on a lower side 13 of the housing base 3 with in each case one plug-type contact 14. The housing 2, in particular the housing cover 4, has approximately the form of a two-dimensional square with a (housing) narrow side 15 and a (housing) broad side 16. The contact arms 5 and 6 are in this case embedded in the housing base 3 in such a way that the plug-type contacts 14 are arranged parallel to one another and approximately centrally with respect to the housing narrow side 15 and spaced apart from one another.

In terms of its outer geometrical dimensions, the circuit breaker 1 is based on the standard ISO 8820 type F (miniature), i.e., it outwardly corresponds to a flat plug-type fuse of the type F in accordance with this standard, with the result that the circuit breaker 1 is compatible with a female plug-type connector for such a flat plug-type fuse, i.e. can be plugged into such a female plug-type connector.

In the view onto the housing broad side 16, the plug-type contacts 14 of the contact arms 5 and 6 are each arranged peripherally. In the housing interior 12, the two contact arms 5 and 6 are each guided inward toward the housing center, with the result that an inner end 17 of the fixed contact arm 5 is arranged above an inner end 18 of the bimetallic contact arm 6. "At the top" is in this case that side of the circuit breaker 1 which is remote from the housing base 3 and the plug-type contacts 14, irrespective of the actual orientation of the circuit breaker 1 in three dimensions.

Figure 3:
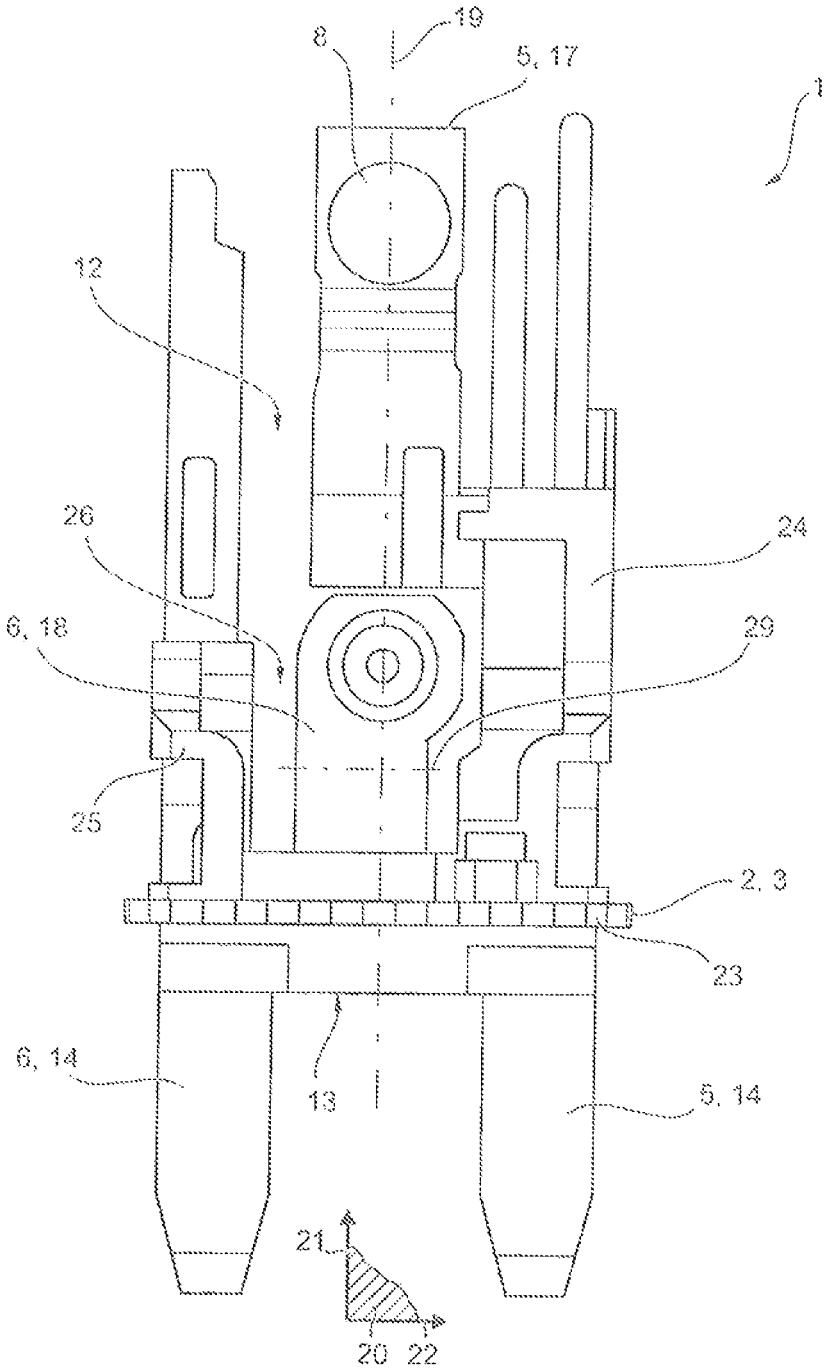
FIG. 3 shows a front view of the contact arms of the circuit breaker shown in FIG. 1, said contact arms being embedded in the housing base.

The inner ends 17 and 18 of the contact arms 5 and 6 are arranged centered with respect to a mid-longitudinal axis 19 (FIG. 3) of the housing 2, in the viewing direction of the housing broad side 16, as can clearly be seen in particular from FIG. 3.

Figure 4:
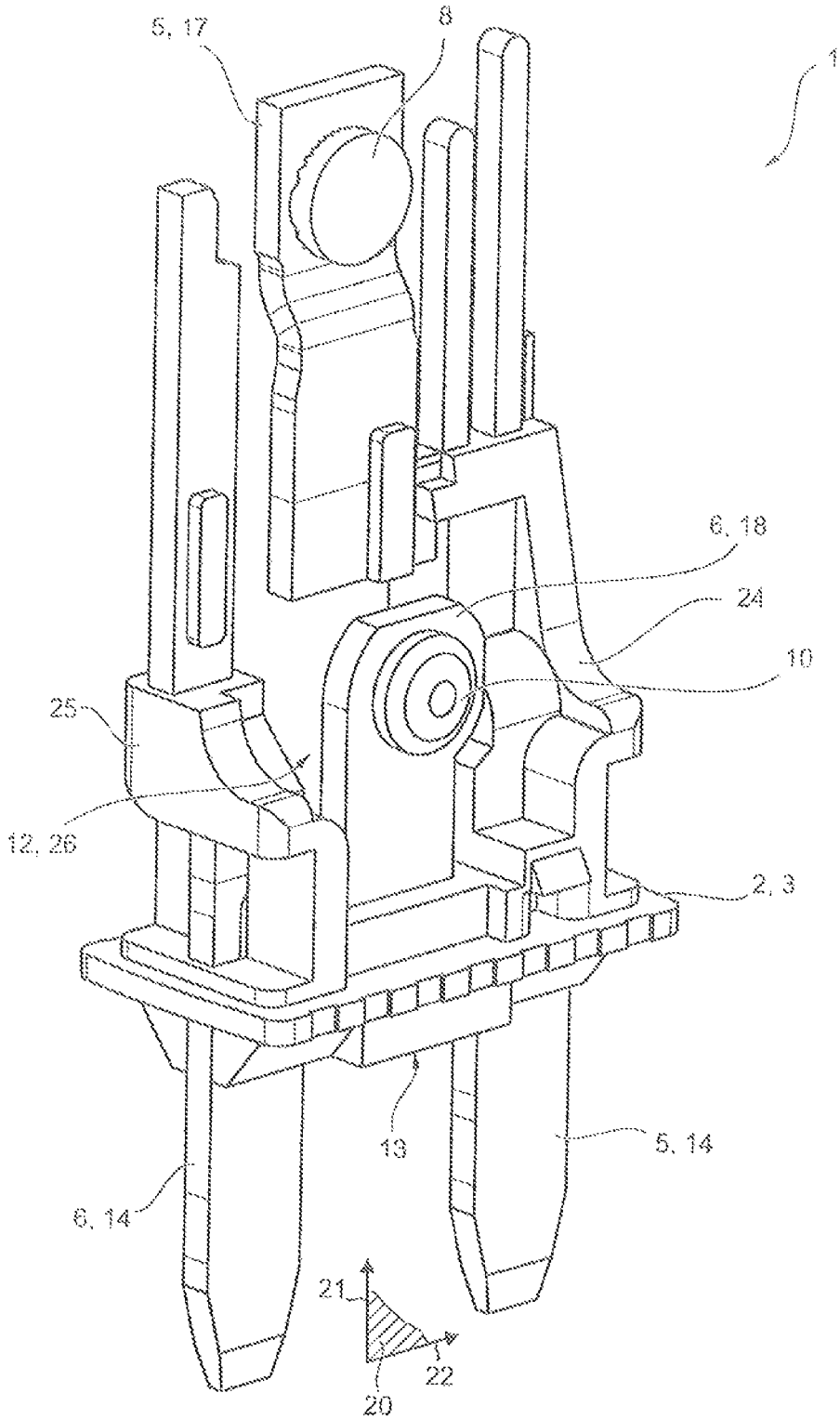
FIG. 4 shows a perspective illustration of the circuit breaker shown in FIG. 1 in the partially fitted state shown in FIG. 3.

As can be seen in particular from the perspective view from an angle in FIG. 4, the inner ends 17 and 18 of the contact arms 5 and 6, respectively, are bent out of the central plane 20, defined by the plug-type contacts 14, of the circuit breaker 1 (when viewed in the viewing direction of the housing narrow side 15) and run approximately parallel to one another, offset with respect to this central plane 20. The inner end 17 of the fixed contact arm 5 is in this case set back with respect to the central plane 20, in the perspective view shown in FIGS. 3 and 4. The inner end 18 of the bimetallic contact arm 6 is positioned in front of the central plane 20, again from the perspective view shown in FIGS. 3 and 4.

The longitudinal extent of the contact arms 5 and 6, and in particular of the plug-type contacts 14 of these contact arms 5 and 6, defines a longitudinal direction 21. The direction arranged perpendicular to the longitudinal direction 21 within the central plane 20 will be referred to below as the transverse direction 22.

In order to better fix the contact arms 5 and 6, the housing base 3 has two arms 24 and 25, which protrude into the interior 12 from a base plate 21, in the transverse direction 22 in each case peripherally and therefore approximately as an extension of the plug-type contacts 14, wherein the fixed contact arm 5 is embedded in the arm 24 and the bimetallic contact arm 6 is embedded in the arm 25. Again when viewed in the transverse direction 22, the arms 24 and 25 leave a free space 26 between them, with the inner ends 17 and 18 of the contact arms 5 and 6 protruding into said free space. In other words, the two ends 17 and 18 of the contact arms 5 and 6, respectively, protrude freely from the base 3 into the interior 12. In this region, therefore at a distance from the housing base 3, the fixed contact 8 is welded (again on the free end side) to the inner end 17 of the fixed contact arm 5. The rivet 10 is likewise fastened on the free end side at the inner end 18 of the contact arm 6, therefore again at a distance from the housing base 3 (see in particular FIGS. 3 and 4).

Figure 5:
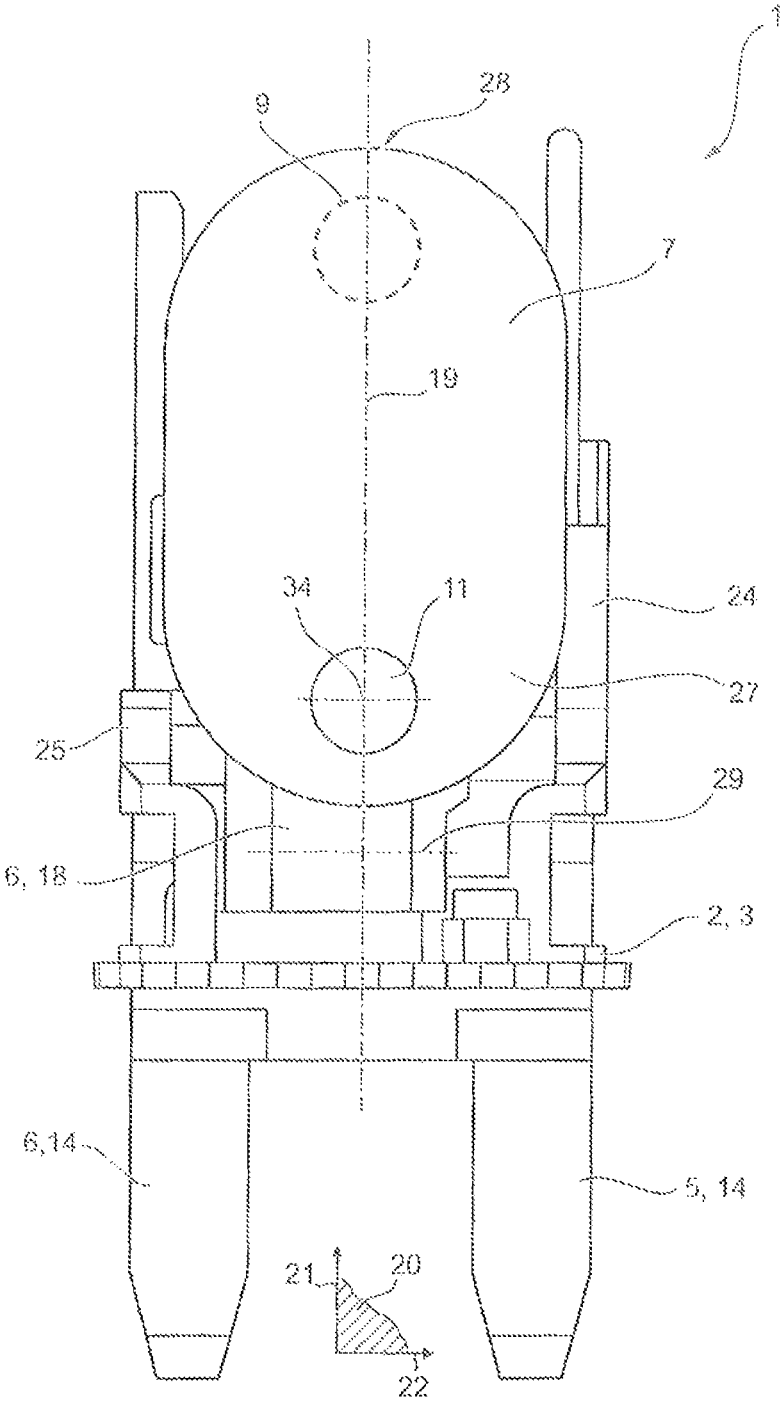
FIG. 5 shows an illustration as shown in FIG. 3 of the circuit breaker shown in FIG. 1 in the fitted state, but without the housing cover.
Figure 6:
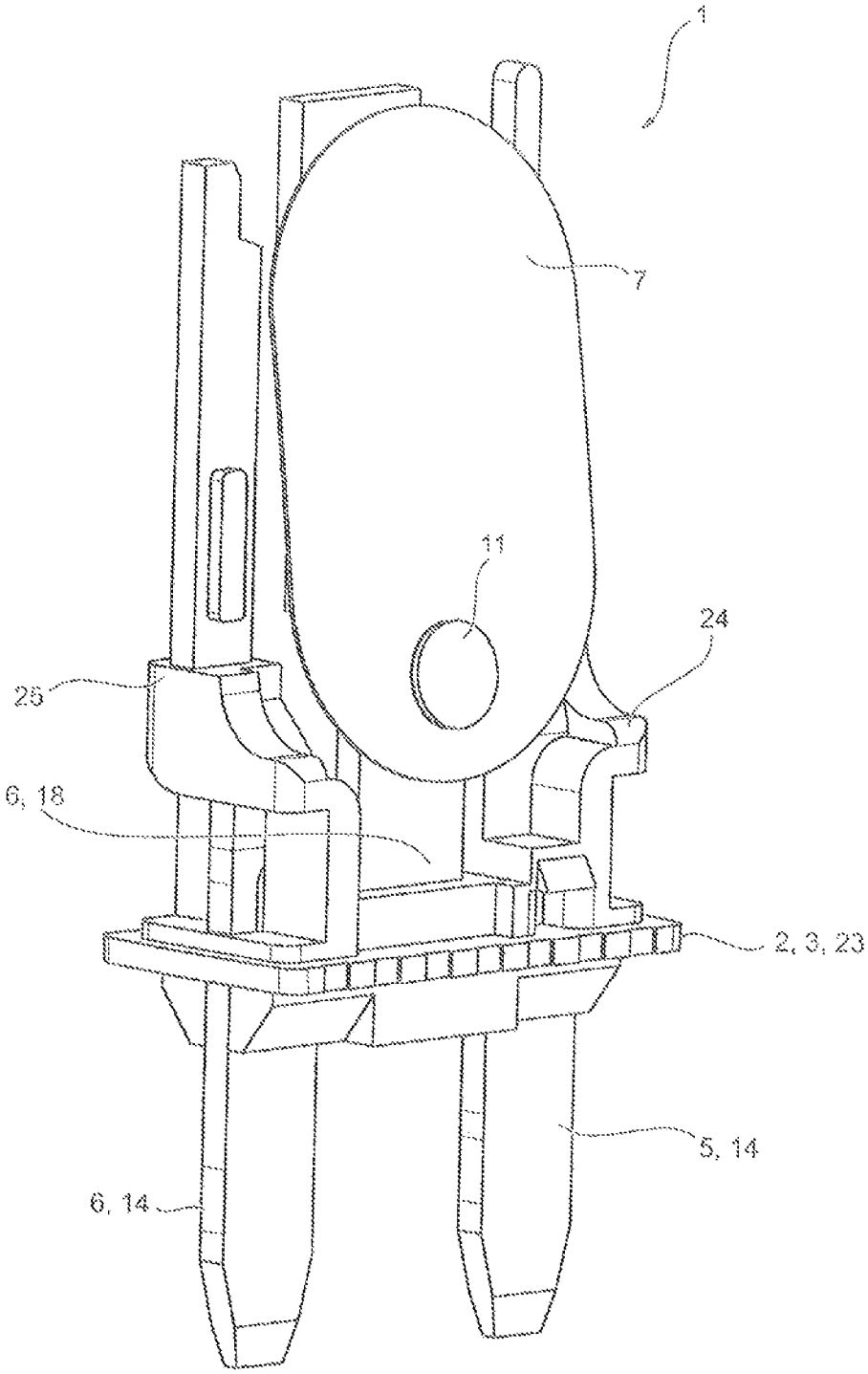
FIG. 6 shows an illustration as shown in FIG. 4 of the circuit breaker shown in FIG. 1 in the fitted state without the housing cover.

The bimetallic snap-action disk 7 is welded onto the rivet 10 by means of the welding platelet 11 (see in particular FIG. 5 or 6). In this case, the bimetallic snap-action disk is arranged in the form of a sandwich between the rivet 10 and the welding platelet 11 in the fitted state, as can be seen in particular from FIGS. 7 and 8. In the fitted state, the oval bimetallic snap-action disk 7 is arranged centered with the mid-longitudinal axis 19 in terms of its longitudinal extent, in the viewing direction of the housing broad side 16 (see FIG. 5). The moving contact 9 and that fastening point 34 of the bimetallic snap-action disk 7 which coincides in three dimensions with the rivet 10 are therefore in particular aligned parallel to the longitudinal direction 21 of the circuit breaker 1 and its contact arms 5 and 6. That end of the bimetallic snap-action disk 7 with which said snap-action disk is fastened to the inner end 18 of the bimetallic contact arm 6 is referred to below as the fixed end 27. The opposite longitudinal end of the bimetallic snap-action disk 7 is freestanding in the interior 12 and is correspondingly referred to as the free end 28. At this free end 28, the bimetallic snap-action disk 7 bears the moving contact 9 in opposition to the fixed contact 8 and on the side of said bimetallic snap-action disk which faces the fixed contact 8 (see in particular FIGS. 7 and 8; in the illustration shown in FIG. 5, the moving contact 9 which is not shown is merely indicated by dashed lines).

Figure 7:
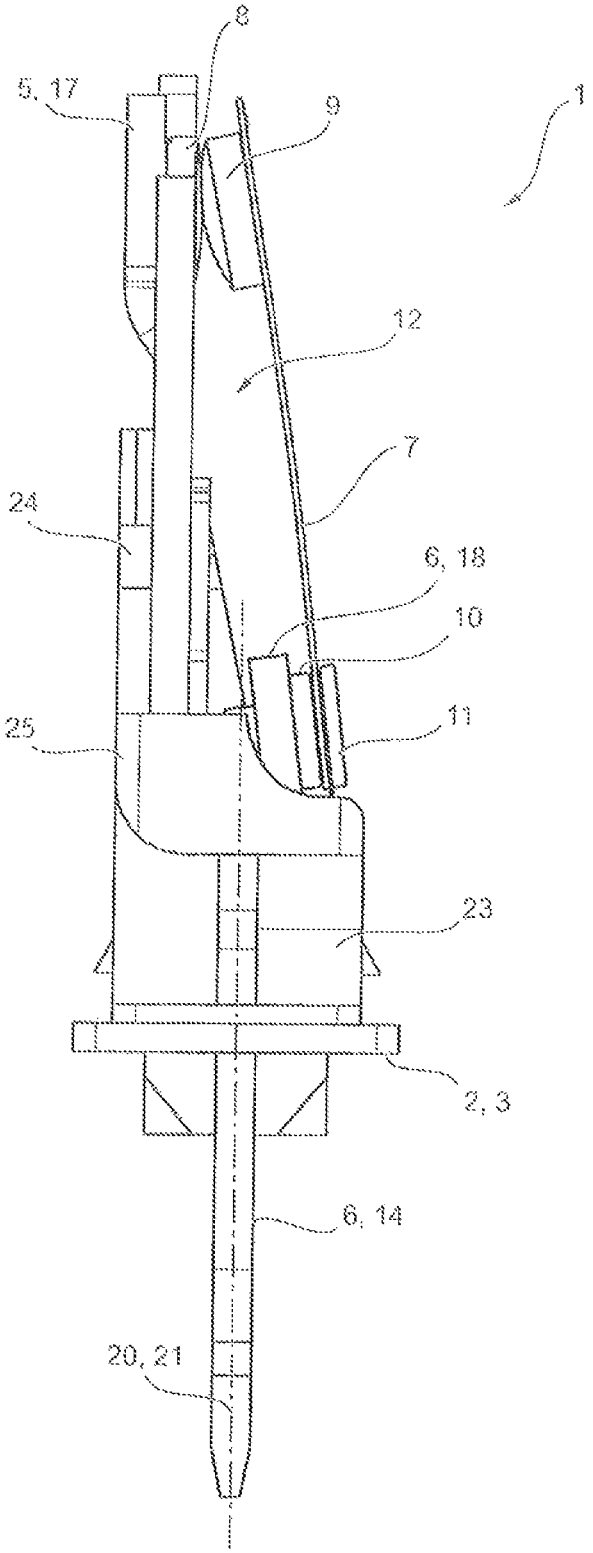
FIG. 7 shows a side view of the circuit breaker shown in FIG. 1 in the fitted state without the housing cover in an (electrically conductive) normal state.

In its normal position, the bimetallic snap-action disk 7 shown in FIG. 7 is arranged at an angle with respect to the central plane 20 in such a way that the moving contact 9 bears against the fixed contact 8 with prestress and thus an electrically conductive connection is formed between the plug-type contacts 14 via the contact arms 5 and 6, the fixed contact 8, the moving contact 9 and the rivet 10. The circuit breaker 1 is therefore electrically conductive in the normal state.

Figure 8:
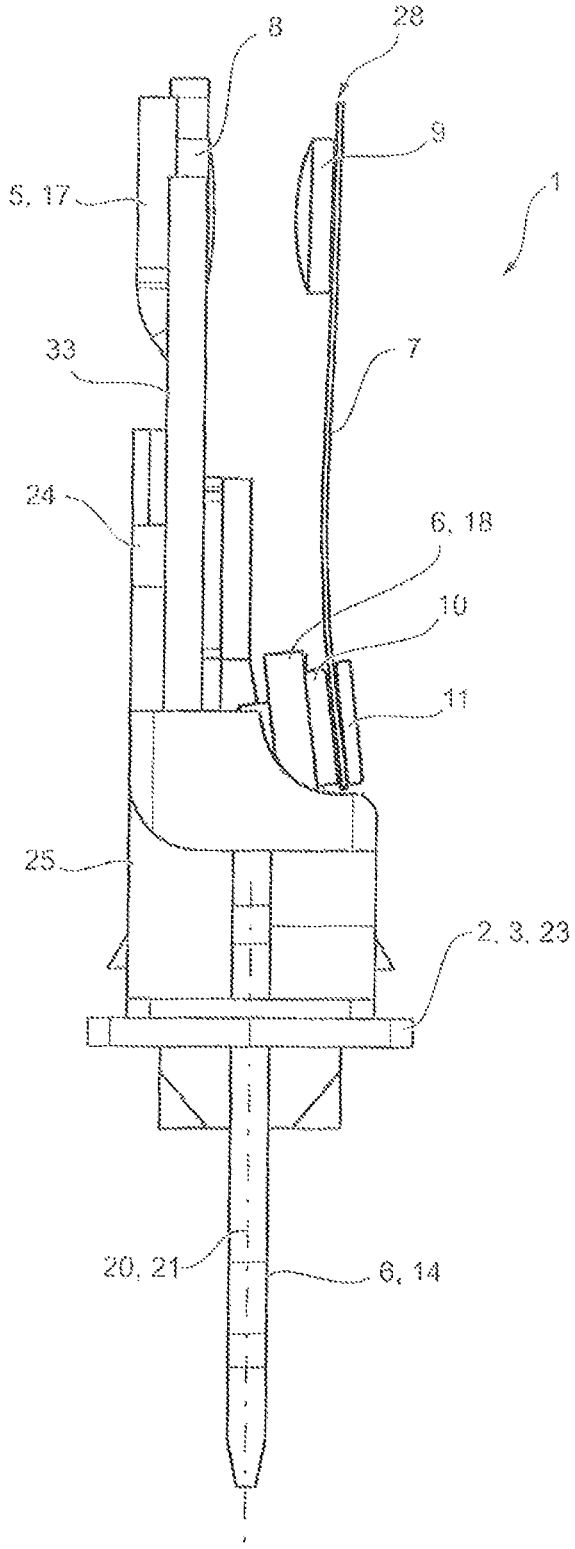
FIG. 8 shows an illustration as shown in FIG. 7 of the circuit breaker shown in FIG. 1 in the tripped state.
Figure 9:
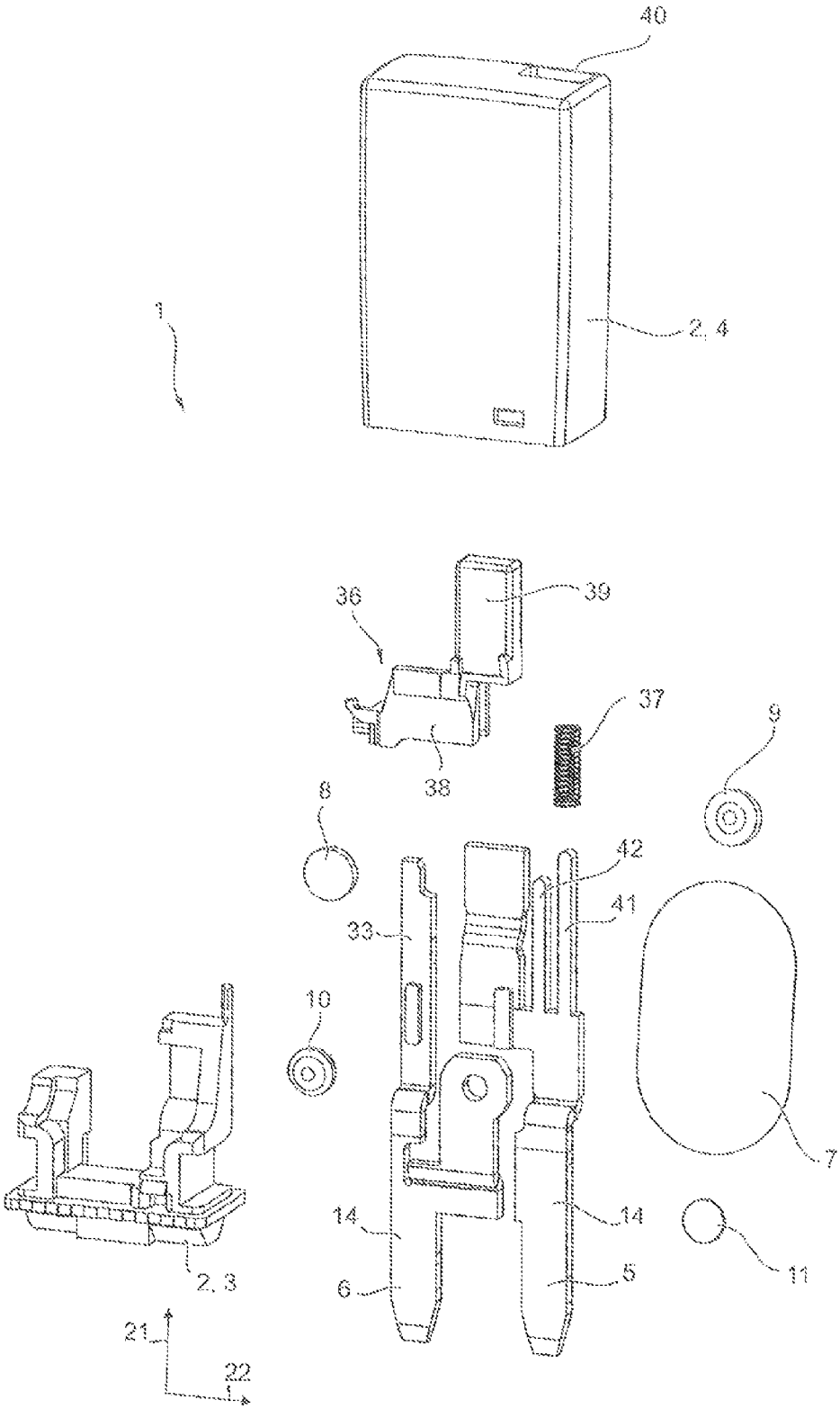
FIG. 9 shows an illustration as shown in FIG. 1 of a second variant of the circuit breaker which additionally comprises (in comparison with the first variant) a disconnecting element and a helical compression spring.

The bimetallic snap-action disk 7 is furthermore designed in such a way that it changes shape suddenly when its temperature exceeds a tripping temperature of preferably 1700° C. which is predetermined according to the construction. This change in shape takes place in such a way that the moving contact 9 is lifted off from the fixed contact 8, and therefore the electrical connection existing between the fixed contact arm 5 and the bimetallic contact arm 6 is disconnected. FIG. 8 shows the circuit breaker 1 in the tripped position.

The change in shape of the bimetallic snap-action disk 7 takes place reversibly depending on its temperature, with the result that the bimetallic snap-action disk 7 springs back into the normal position shown in FIG. 7 when its temperature falls below a spring-back temperature predetermined according to the construction. In order to avoid excessively frequent switching of the bimetallic snap-action disk, said bimetallic snap-action disk optionally has elastic hysteresis, in which the spring-back temperature is lowered in comparison with the tripping temperature. In this case, therefore, the circuit breaker is conductive again only when the spring-back temperature is lower than the tripping temperature.

During fitting of the circuit breaker 1, the contact arms 5 and 6 which are stamped out, bent in shape and are provided with the fixed contact 8 or the rivet 10 are encapsulated by injection molding with the housing base 3 and therefore are embedded therein. Then, the bimetallic snap-action disk 7 provided with the moving contact 9 is welded to the bimetallic contact arm 6 more precisely to the rivet 10. The bimetallic snap-action disk 7 is in this case first welded in such a way that the moving contact 9 is spaced apart from the fixed contact 8 or merely rests thereon loosely, i.e. the bimetallic snap-action disk 7 is initially not under prestress. The required prestress of the bimetallic snap-action disk 7 in the normal state is only produced in a subsequent manufacturing step by virtue of the inner end 18 of the bimetallic contact arm 6 being bent around a bending axis 29 which runs in a transverse direction 22 and is sufficiently well spaced apart from the housing base 3 (see FIGS. 3 and 5). The bending of the end 18 is performed in this case toward the rear in the illustration shown in FIGS. 3 and 5, and therefore in the direction toward the end 17 of the fixed contact arm 5. The bending is preferably performed in regulated fashion, with the bending process being continued until the bimetallic snap-action disk 7 has reached a predetermined desired prestress.

Bending back the end 18 therefore makes it possible to compensate for an adjustment of the circuit breaker 1 by means of the manufacturing tolerances, in particular when the contact arms 5 and 6 are embedded in the housing base 3, and a uniform, precise tripping response of the circuit breaker 1 can thus be ensured.

As a result of this adjustment, the inner end 18 of the bimetallic contact arm 6 is arranged slightly at an angle with respect to the central plane 20 of the circuit breaker 1 in the final fitted state (as is indicated in exaggerated form in FIGS. 7 and 8).

In a final fitting step, the housing cover 4 is snapped onto the housing base 3.

In the simple variants shown in FIGS. 1 to 8, the circuit breaker 1 functions intermittently. In the event of an overload, in particular in the event of a short circuit, the bimetallic snap-action disk 7 is heated by the electrical power loss until the tripping temperature is exceeded, and the bimetallic snap-action disk 7 disconnects the circuit by virtue of suddenly changing shape. As a result of the now necessarily collapsing current flow, gradual cooling of the circuit breaker 1 and therefore also of the bimetallic snap-action disk 7 occurs. As soon as the temperature of the bimetallic snap-action disk 7 falls below the spring-back temperature again, the bimetallic snap-action disk 7 springs back into the normal position, as a result of which the circuit is closed again. If at this point in time the overload condition, in particular the short circuit, continues, this results in a renewed electrical overload and, as a result, in renewed tripping of the circuit breaker 1. The tripping sensitivity of the circuit breaker 1 is in this case significantly improved by the housing cover 4 consisting of plastic (with a given design of the bimetallic snap-action disk 7), said housing cover effectively thermally insulating the interior 12 of the circuit breaker 1. By virtue of the thermally insulating housing 2, the switch-off duration of the circuit breaker 1 is also extended in the event of an overload since the cooling of the bimetallic snap-action disk 7 after tripping is slowed down. This is kinder both on the circuit protected by the circuit breaker 1 and on the circuit breaker 1 itself.

A second variant of the circuit breaker 1 is described with reference to FIGS. 9 to 15. This second variant resembles the first variant in terms of the design, fitting and operation if no differences are described below. In particular, the housing base 3, the contact arms 5 and 6, the bimetallic snap-action disk 7, the fixed contact 8, the moving contact 9 and the rivet 10 and the welding platelet 11 are identical to the corresponding parts of the above-described embodiment. Instead of the heating resistor 30, the second variant of the circuit breaker 1 shown in FIGS. 9 to 15 comprises a disconnecting element 36 and a helical compression spring 37.

The disconnecting element 36 is in the form of an integral plastic injection-molded part and comprises substantially a disconnecting plate 38 and a pushbutton 39.

Figure 10:
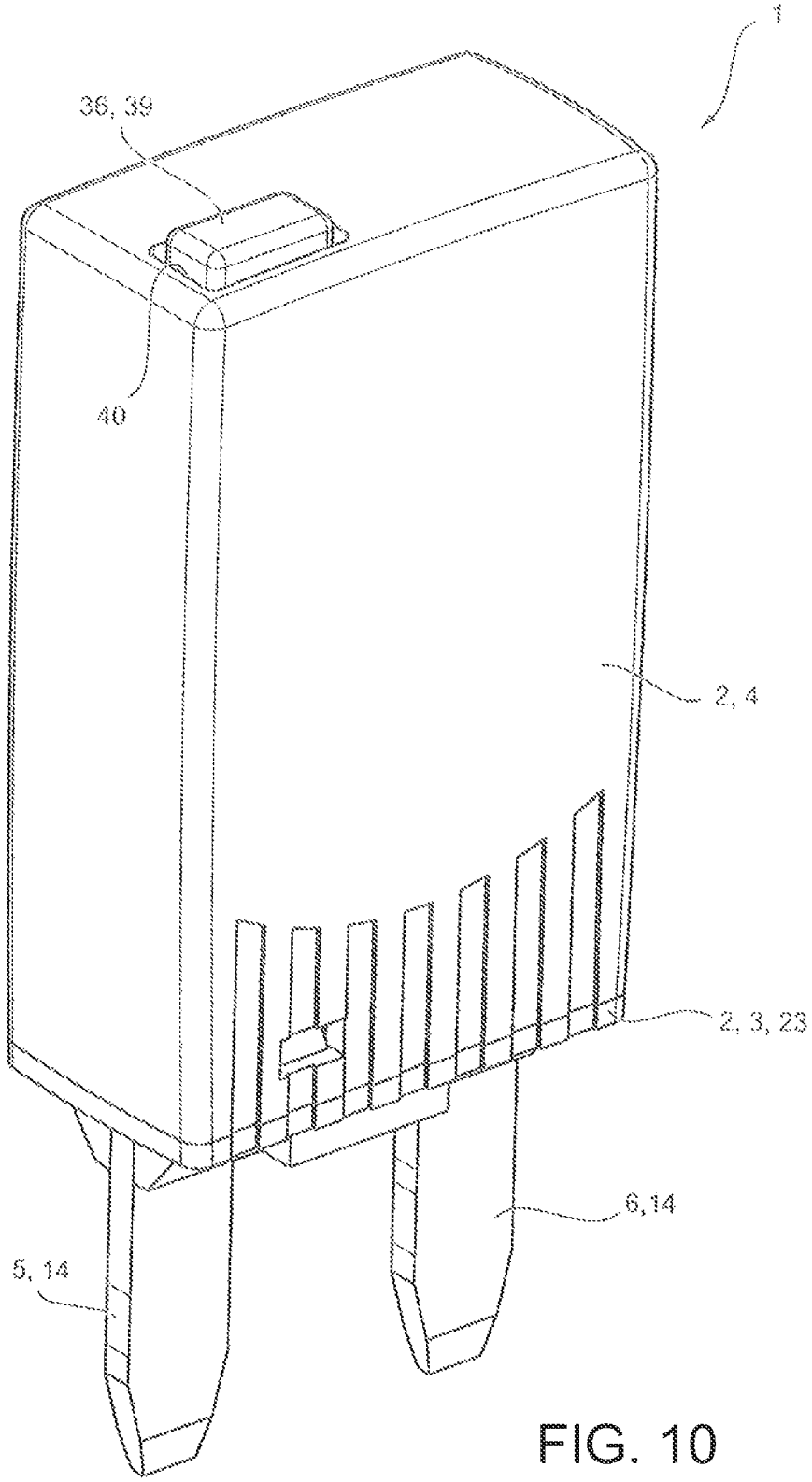
FIG. 10 shows an illustration as shown in FIG. 2 of the circuit breaker shown in FIG. 9.
Figure 11:
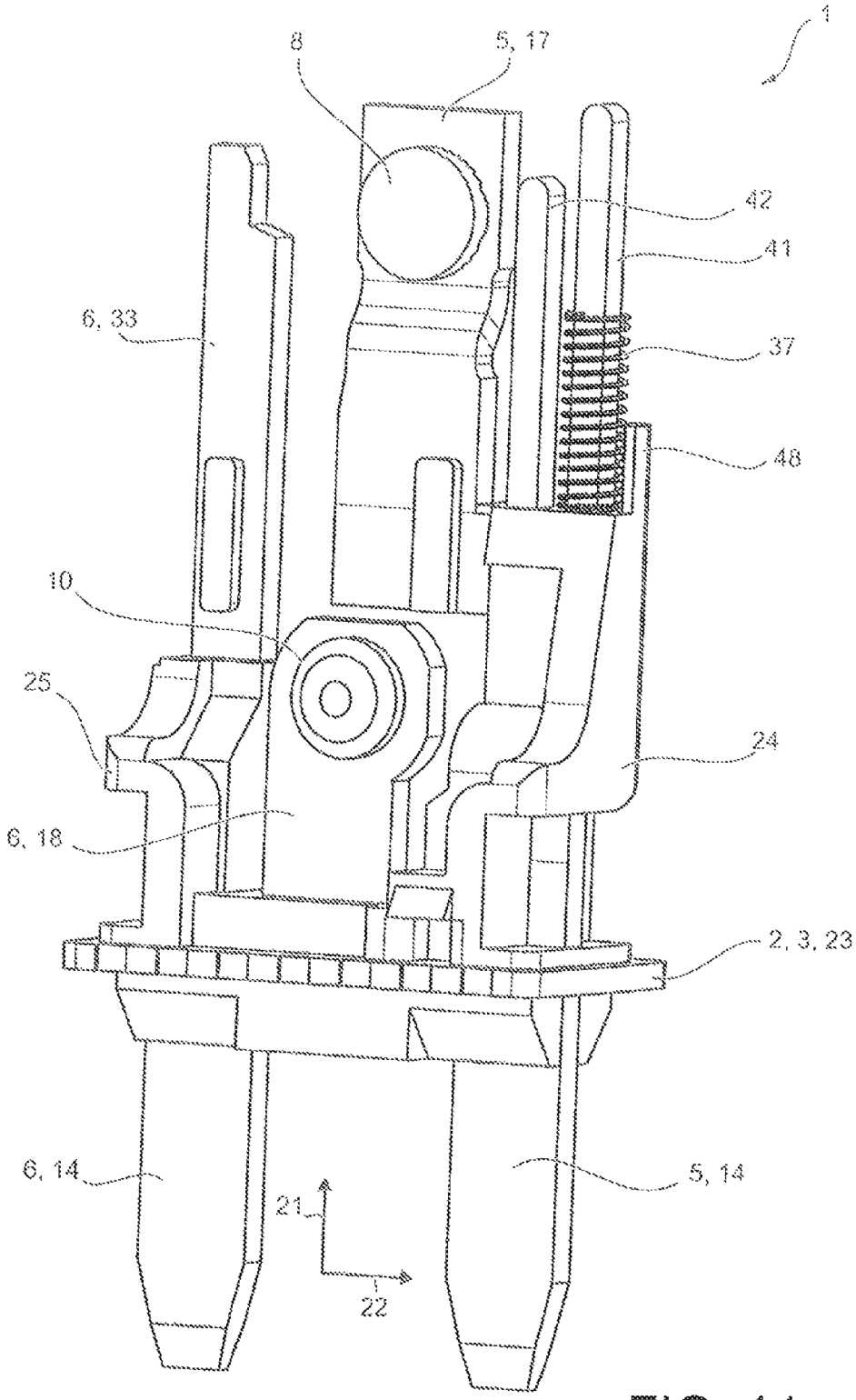

The housing cover 4 corresponds substantially to the housing cover 4 in the above-described variant of the circuit breaker 1, but, as a deviation from this, has a cutout 40 in its upper surface, with the pushbutton 39 of the disconnecting element 36 protruding through said cutout 40 out of the housing 2 in the installed state. FIG. 10 shows the circuit breaker 1 in the fitted state, and in particular the pushbutton 39 protruding out of the housing 2.

In the fitted state, the helical compression spring 37 and the pushbutton 39 are guided on the fixed contact arm 5. For this purpose, the fixed contact arm 5 has two thin, elongated guide pins 41 and 42. The helical compression spring 37 is in this case pushed onto the guide pin 41 positioned on the outside (see in particular FIG. 11). Then, the pushbutton 39 is pushed onto the guide pins 41 and 42, with the result that the helical compression spring 37 is positioned between the arm 24 of the housing base 2 and the pushbutton 39 in the manner of a sandwich (see FIG. 12). In order to accommodate the guide pins 41 and 42 in a form-fitting manner, the pushbutton 39 in this case has a receptacle which is substantially matched to the dimensions of the pins 41 and 42. This receptacle is optionally formed from two separate bores for accommodating in each case one of the guide pins 41 and 42 or by a slit-shaped opening, in which the two guide pins 41 and 42 are positioned together.

Figure 12:
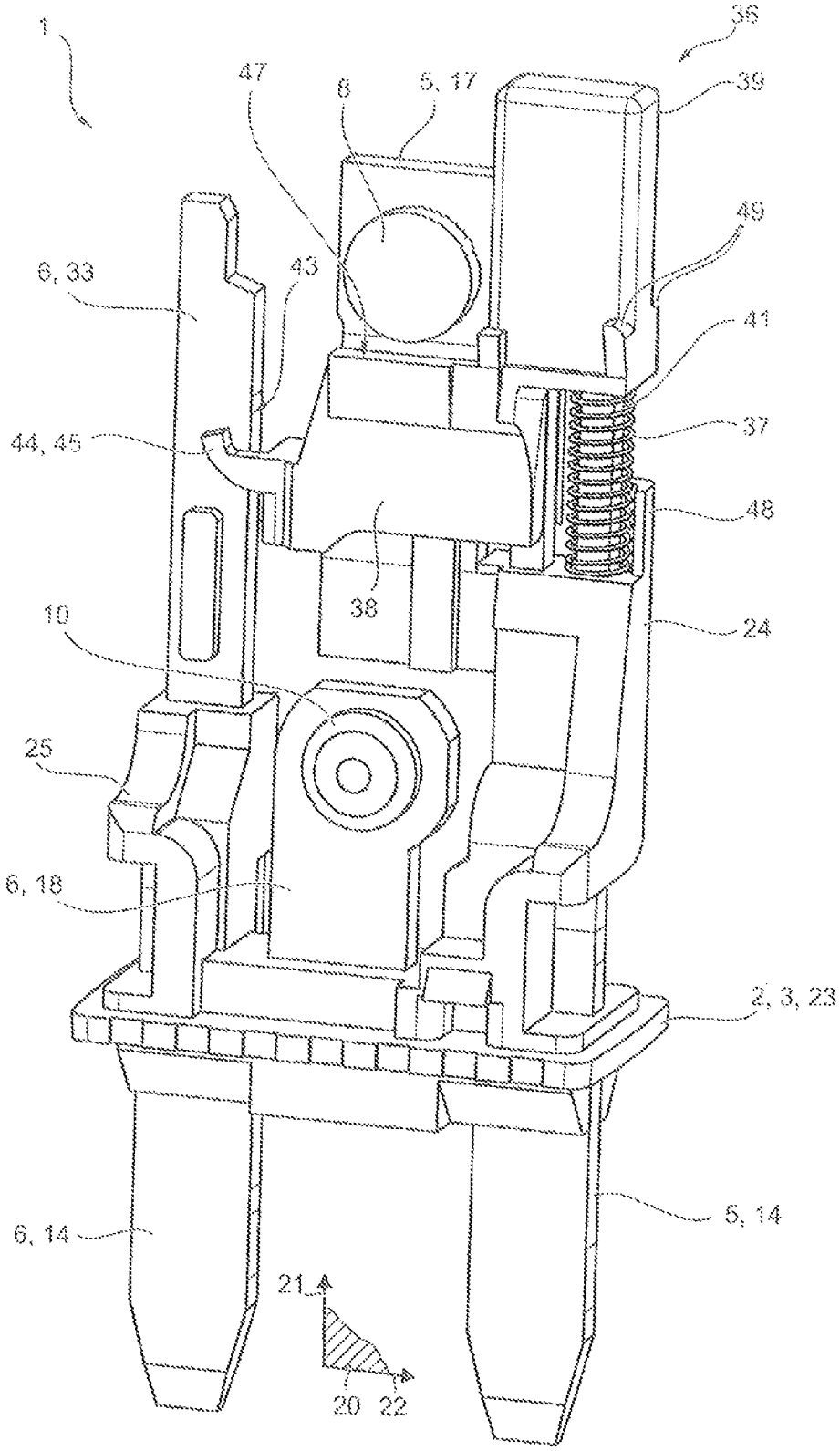
FIG. 12 shows an illustration as shown in FIG. 11 of the circuit breaker shown in FIG. 9 with an additionally fitted disconnecting element.
Figure 13:
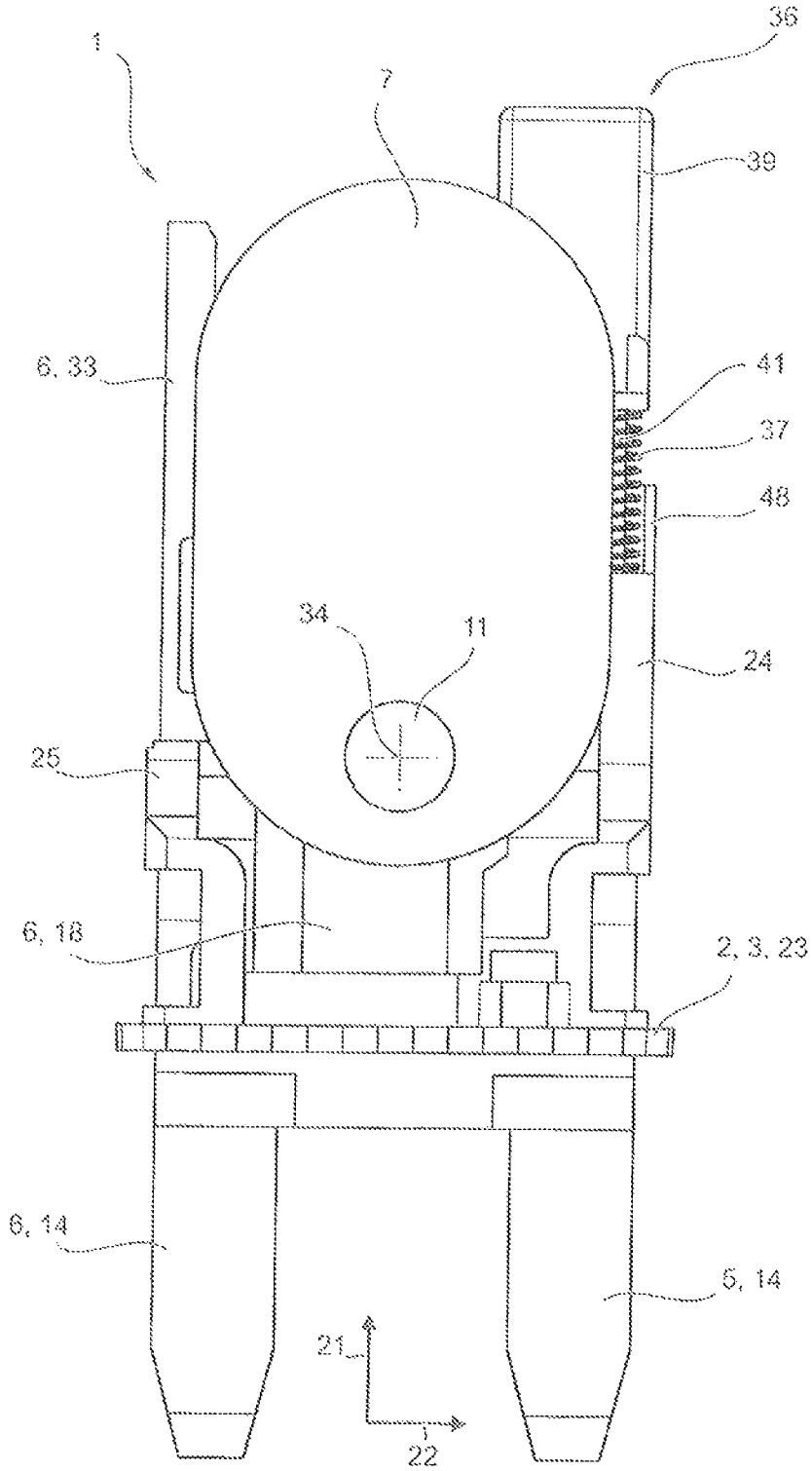
FIG. 13 shows a front view of the circuit breaker shown in FIG. 9 in the fitted state without the housing.
Figure 14:
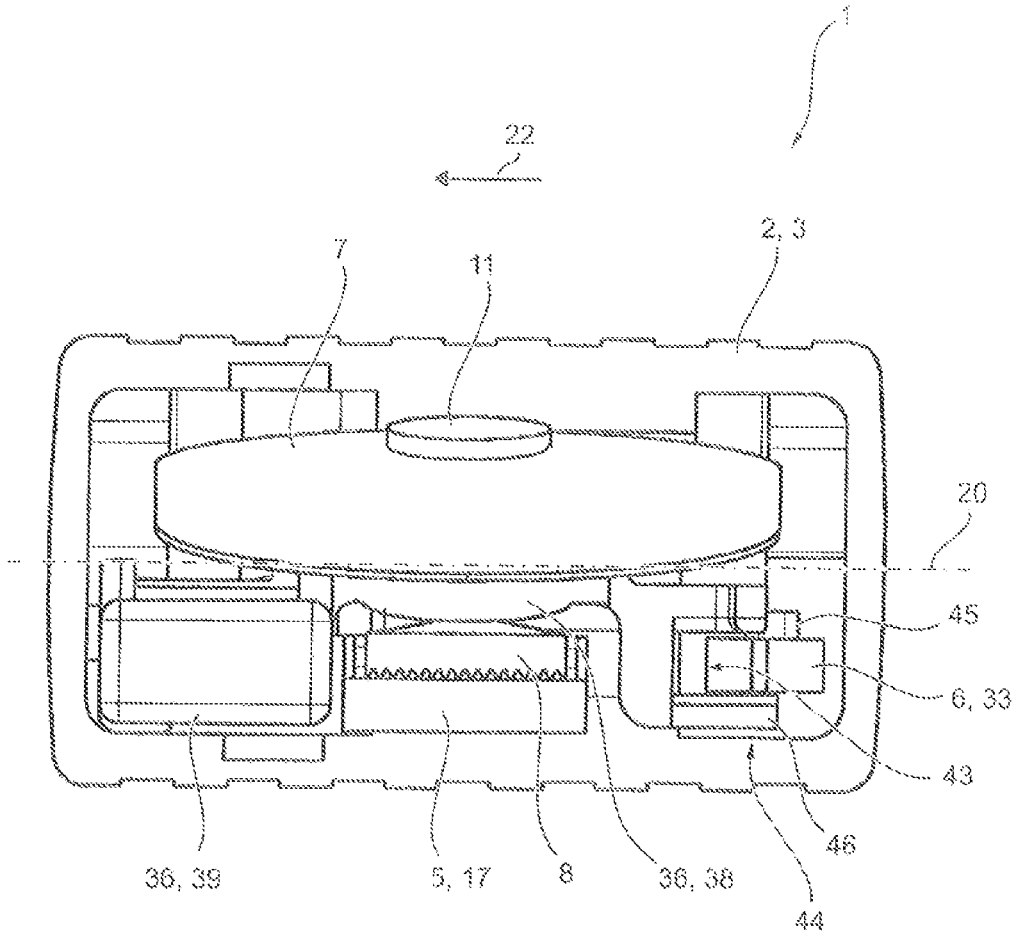
FIG. 14 shows a plan view from above of the circuit breaker shown in FIG. 9 in the fitted state without the housing.

In the installed position of the disconnecting element 36, the disconnecting plate 38 protrudes approximately in the transverse direction 22 from the pushbutton 39 and is positioned in front of the inner end 17 of the fixed contact arm 5 in a manner approximately coplanar to the central plane 20 (see FIG. 12). It is therefore positioned in particular between the inner end 17 of the fixed contact arm 5 and the bimetallic snap-action disk 7. At its rim remote from the pushbutton 39 in the transverse direction 22, the disconnecting plate 38 is guided on the inner rim of a longitudinal protrusion 33 of the contact arm 6, which protrudes into the interior 12 for example as an extension of the plug-type contact 14. This inner rim therefore forms a guide burr 43 for the disconnecting plate 38. The disconnecting plate 38 engages around this guide burr 43 with an integrally formed, fork-like guide contour 44. This guide contour 44 has two prongs 45 and 46 which engage around the guide burr 43 at the front and rear (see in particular FIG. 14). The two prongs 45 and 46 of the guide contour 44 are offset slightly with respect to one another in the longitudinal direction 21 (as can be seen in particular from FIG. 15) in order to facilitate the "threading" of the guide contour 44 onto the guide burr 43 of the longitudinal protrusion 33.

In the installed state, the disconnecting element 36 is guided on the guide pins 41 and 42 and on the guide burr 43 in a manner such that it can be displaced in the longitudinal direction 21 between a disconnected position and an enable position. In the enable position (illustrated in FIGS. 12 and 15), the disconnecting plate 38 is arranged beneath the fixed contact 8 and the moving contact 9. To be more precise, the disconnecting plate 38 (when viewed in the longitudinal direction 21) is arranged between the fixed contact 8 and the moving contact 9 on one side and the end 18 of the contact arm 6 or the fastening point 34 of the bimetallic snap-action disk 7. The disconnecting plate 38 is therefore drawn back out of the region of the fixed contact 8 and the moving contact 9, with the result that the moving contact 9 can come into contact with the fixed contact 8 in unimpeded fashion. In the disconnected position (illustrated in FIG. 14), the disconnecting element 36 is moved upward (in comparison with the illustration shown in FIG. 12, with the result that the disconnecting plate 38 is positioned between the fixed contact 8 and the moving contact 9.

The disconnecting element 36 is prestressed by the helical compression spring 36 upward, i.e. in the direction toward the disconnected position. Under the pressure of the spring, the disconnecting element 36 automatically assumes the disconnected position when the moving contact 9 is lifted off from the fixed contact 8 as the circuit breaker 1 is tripped. The disconnecting plate 38 therefore slides between the fixed contact 8 and the moving contact 9 and prevents the electrical connection between the fixed contact 8 and the moving contact 9 from being closed again when the bimetallic snap-action disk 7 cools.

The enable position of the disconnecting plate 38 corresponds to a position of the pushbutton 39 in which the pushbutton 39 terminates flush with the upper edge of the housing cover 4 or only protrudes slightly out of the housing 2 toward the outside. This position of the pushbutton 39 is referred to as the depressed position.

The disconnected position of the disconnecting plate 38, on the other hand, corresponds to a position of the pushbutton 39 in which said pushbutton protrudes (possibly further) out of the housing 2 than in the depressed position. This position of the pushbutton 39 will be referred to below as the "extended position".

Figure 15:
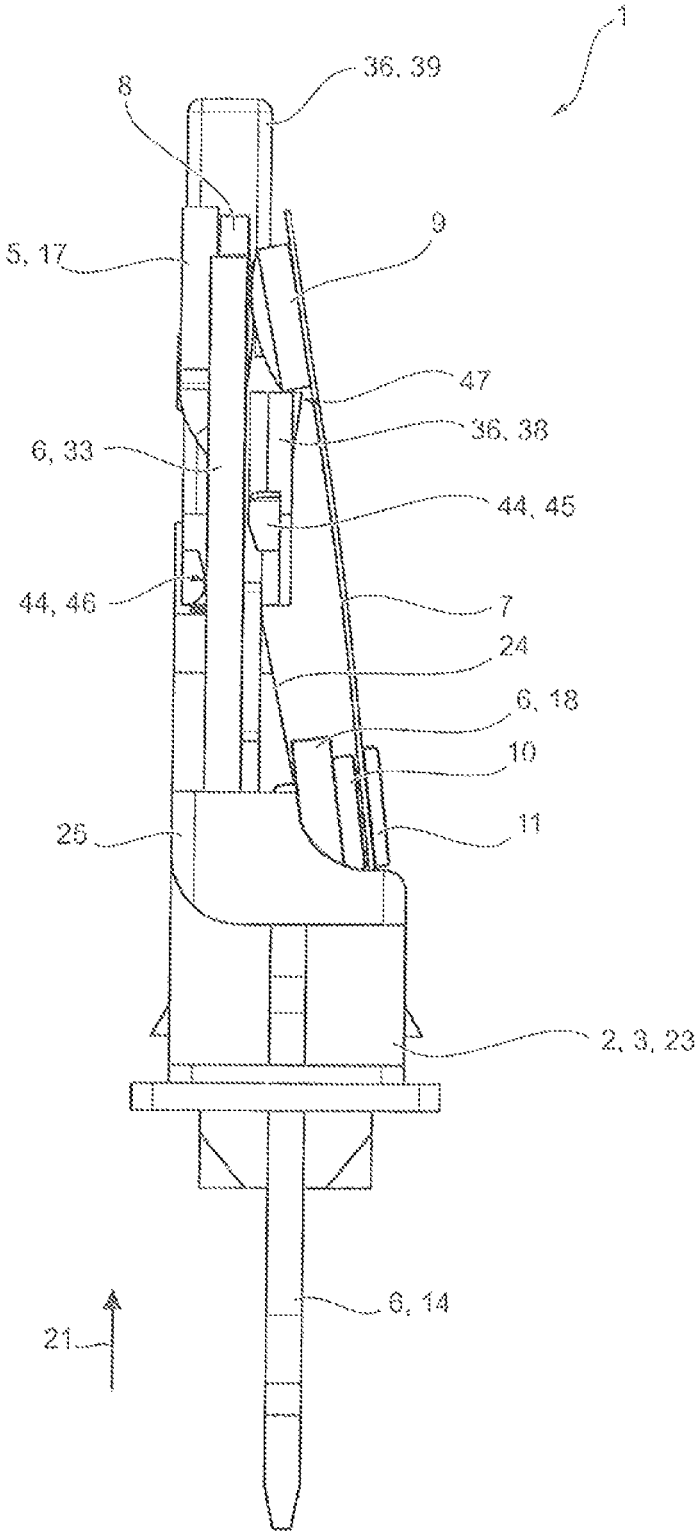
FIG. 15 shows a side view of the circuit breaker shown in FIG. 9 in the fitted state without the housing in its normal state.

By manually exerting pressure on the pushbutton 39, said pushbutton 39 can be shifted back into the depressed position from its extended position counter to the spring pressure of the helical compression spring 37, as a result of which the disconnecting plate 38 is shifted back into the enable position again and the bimetallic snap-action disk 7 again brings the moving contact 9 to bear against the fixed contact 8, if the temperature of the bimetallic snap-action disk 7 falls below the spring-back temperature. In the normal position of the circuit breaker 1 which is therefore again produced, the disconnecting plate 38 stops against the moving contact 9 under the spring pressure of the helical compression spring 37 from below (see FIG. 15) and is therefore locked in its enable position. In order to avoid undesired self-tripping of the circuit breaker 1, for example under the influence of vibrations, the disconnecting plate 38 is provided with a sharp upper edge (referred to below as the stop edge 47), at least on its front side facing the bimetallic snap-action disk 7, and the disconnecting plate 38 bears with this upper edge against the moving contact 9. The stop edge 47 is therefore set at an angle with respect thereto, in particular toward the outside, therefore toward the bimetallic snap-action disk 7, as shown in FIGS. 12 and 15.

The path along which the pushbutton 39 is shifted is delimited at the bottom by a stop 48, which is integrally formed on the arm 24 of the housing base 3. The stop 48 flanks the helical compression spring 37 and is dimensioned with a sufficient length to eliminate the possibility of the helical compression spring 37 being squashed. At the top, the path along which the pushbutton 39 is shifted is delimited by stops 49, which are integrally formed at the lower end of the pushbutton 39 and with which the pushbutton 39 stops against the housing cover 4 in the extended position.

Figure 16:
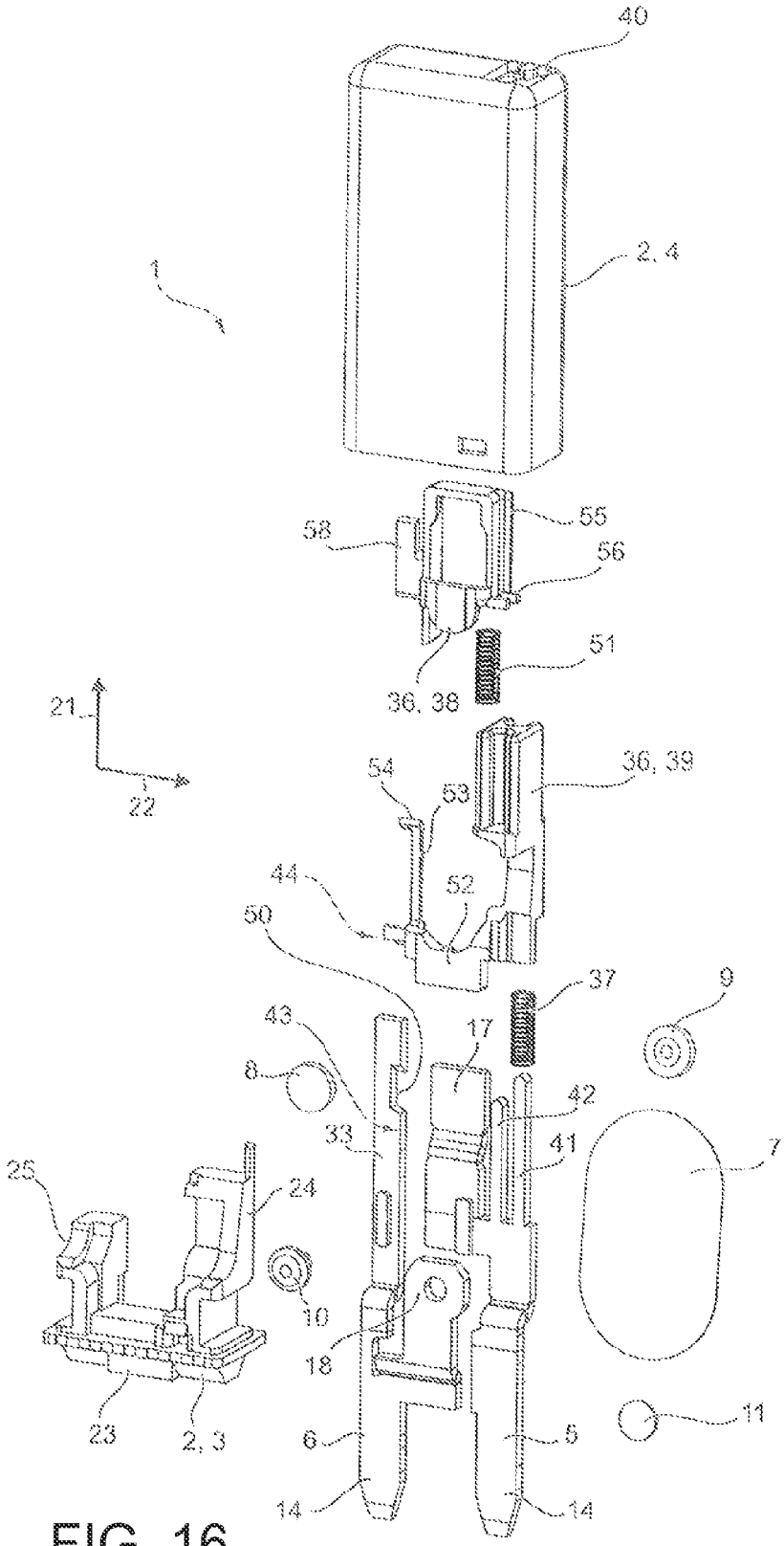
FIG. 16 shows an illustration as shown in FIG. 1 of a third variant of the circuit breaker which comprises a two-part disconnecting element and, in comparison with the second variant, an additional helical compression spring.
Figure 17:
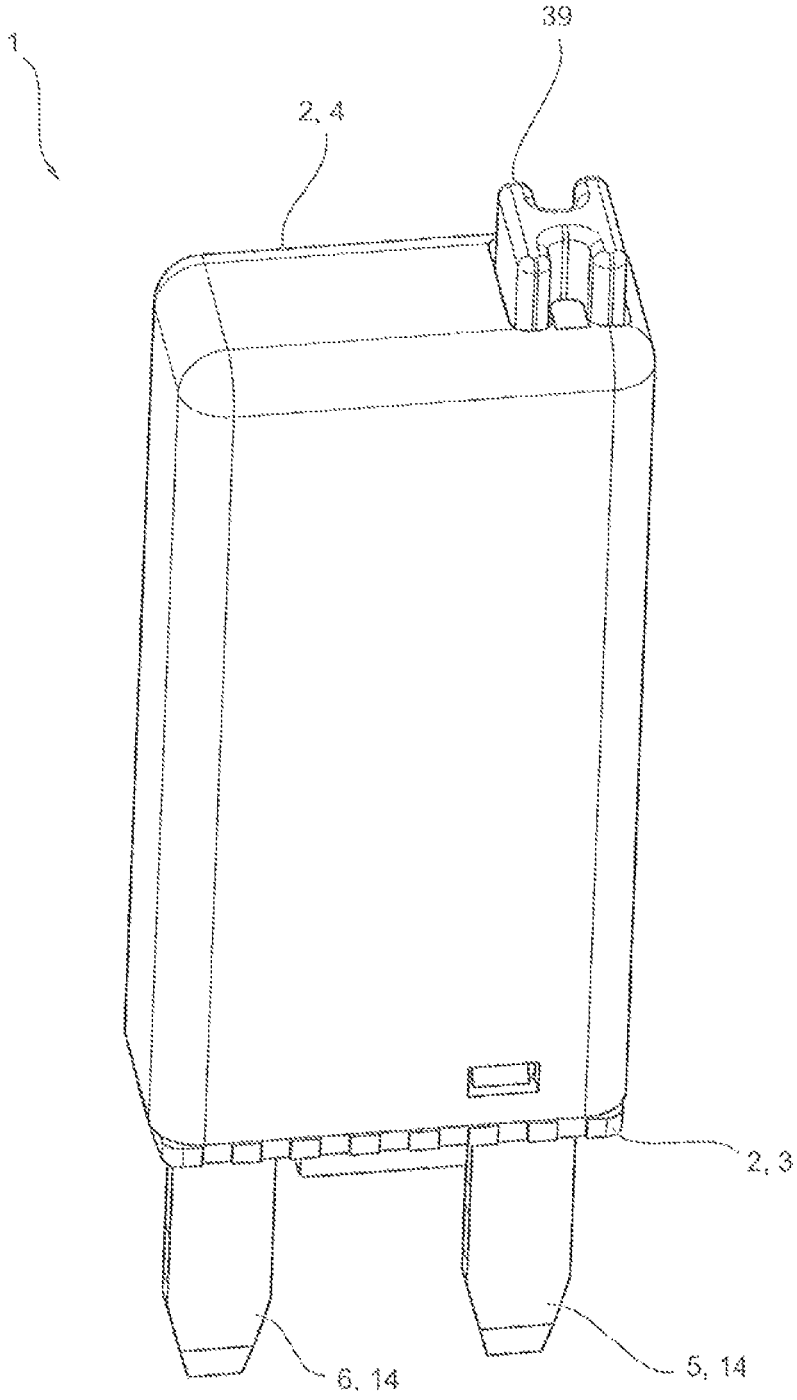
FIG. 17 shows an illustration as shown in FIG. 2 of the circuit breaker shown in FIG. 16.

A further improved variant of the embodiment of the circuit breaker 1 described above is illustrated in FIGS. 16 to 24. In this variant, the disconnecting plate 38 and the pushbutton 39 of the disconnecting element 36 are formed as separate component parts, which are guided such that they can be shifted with respect to one another in order to enable free tripping of the circuit breaker 1. The housing base 3, the fixed contact arm 5, the bimetallic snap-action disk 7, the fixed contact 8, the moving contact 9, the rivet 10 and the welding platelet 11 are in turn identical to the corresponding parts of the above-described embodiments. Furthermore, the bimetallic contact arm 6 is also largely identical to the bimetallic contact arm 6 in the above-described embodiments. As a deviation from this, only the longitudinal protrusion 33 shown in FIG. 16 is extended upward in comparison with the bimetallic contact arm 6 in the above-described embodiments, with the result that a notch 50 is formed in its inner edge, which forms the guide burr 43, approximately at the same height as the fixed contact 8. The housing cover 4 also substantially corresponds to the housing cover 4 shown in FIG. 9. Only the shape of the cutout 40 is modified, so as to match a cross section of the pushbutton 39 which is modified in the exemplary embodiment shown in FIGS. 16 to 24 and in this case substantially has the form of the letter "H". The closed housing 2 with the pushbutton 39 protruding out of the housing 2 is illustrated in FIG. 17.

Figure 18:
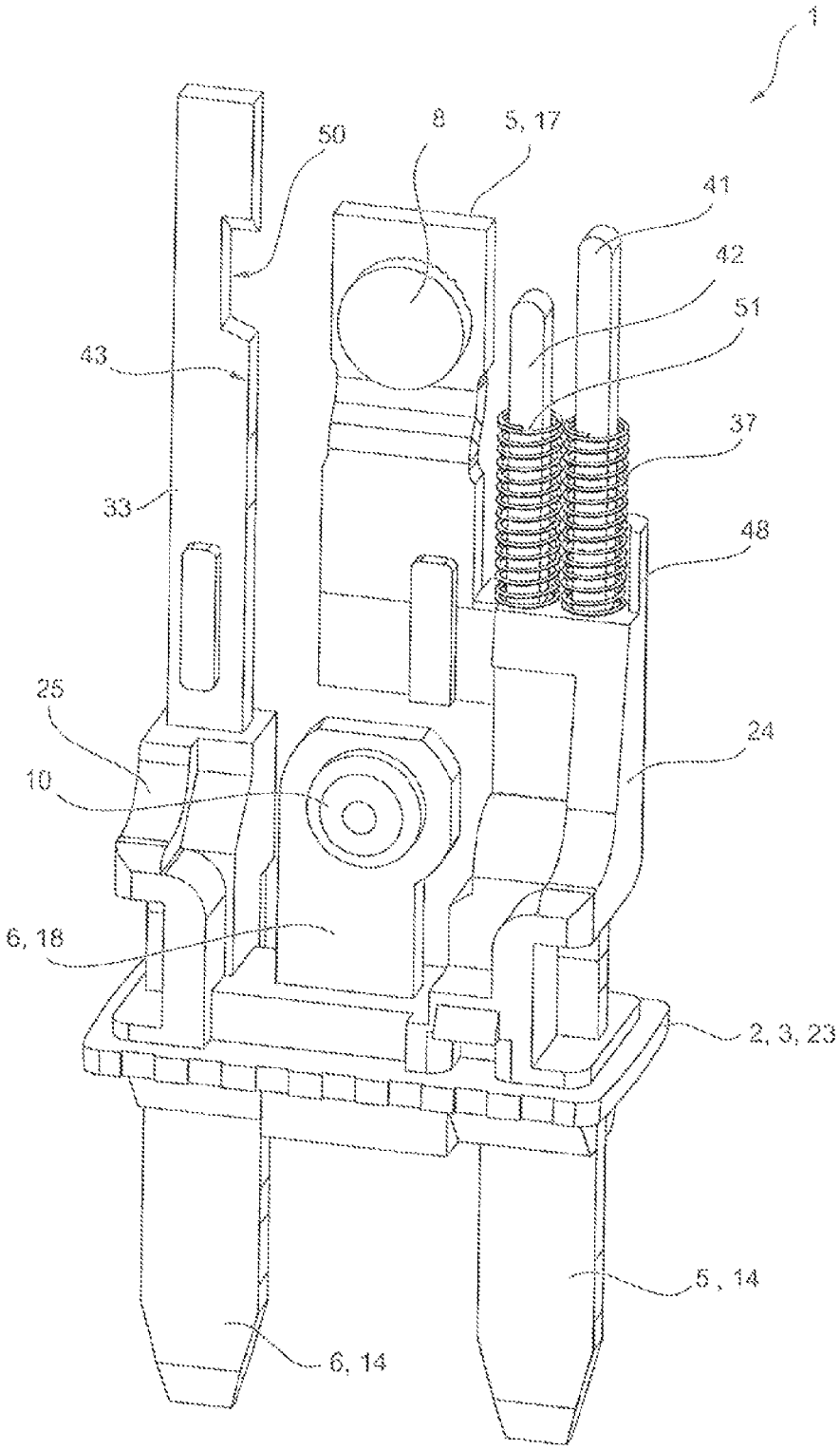
FIG. 18 shows an illustration as shown in FIG. 11 of the circuit breaker shown in FIG. 16.

In order to prestress the disconnecting plate 38, the circuit breaker 1 in the embodiment shown in FIGS. 16 to 24 comprises an additional helical compression spring 51, which is pushed onto the guide pin 42, parallel to the helical compression spring 37 (see FIG. 18).

Figure 19:
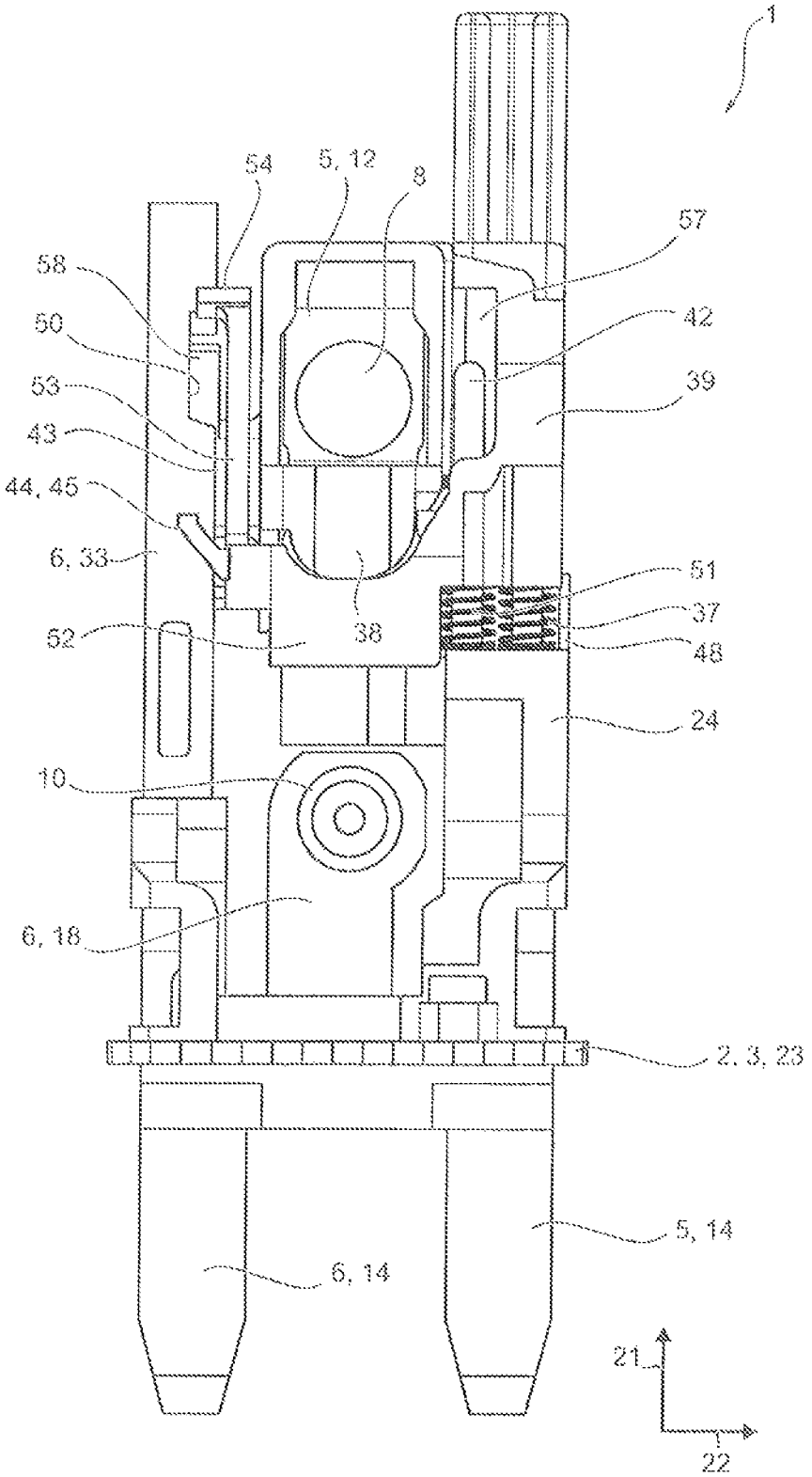
FIG. 19 shows an illustration as shown in FIG. 12 of the circuit breaker shown in FIG. 16.
Figure 20:
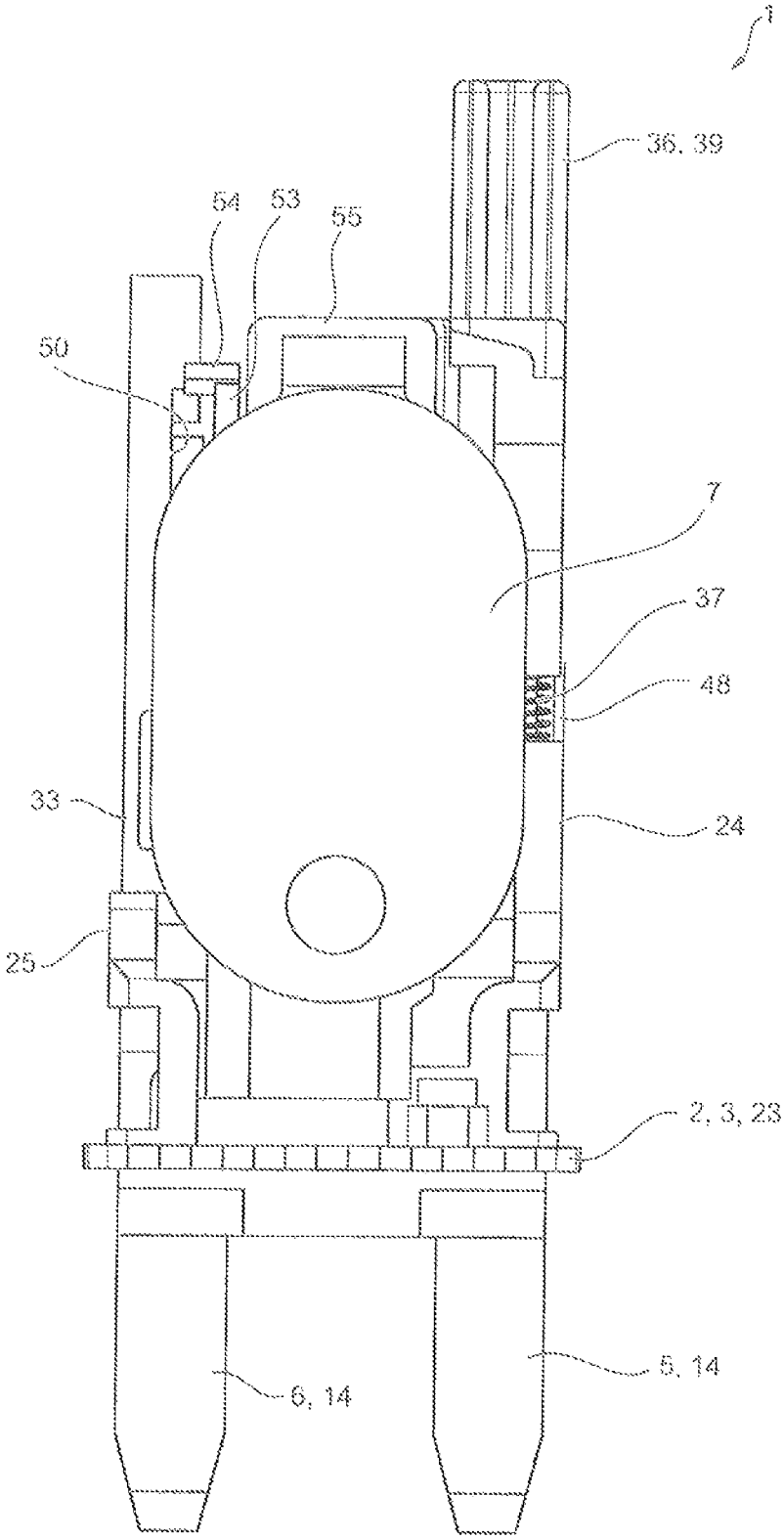
FIG. 20 shows an illustration as shown in FIG. 13 of the circuit breaker shown in FIG. 16.

The pushbutton 39 comprises an integrally formed transverse strut 52, which engages beneath the disconnecting plate 38 in the fitted state (see FIG. 19). In this case, the guide contour 44, which engages around the guide burr 43 beneath the notch 50 as described above (in this case in particular so as to prevent the pushbutton 39 from rotating) is integrally formed on that free end of the transverse strut 52 which faces the longitudinal protrusion 33 of the bimetallic contact arm 6. Furthermore, a spring arm 53 which protrudes in the longitudinal direction 21 is integrally formed on the free end of the transverse strut 52 and is provided with a driver 54 at its free end. In the fitted state, the spring arm 53 extends at a short distance from the guide burr 43 approximately parallel to the longitudinal protrusion 33 (FIG. 19), wherein the driver 54 overlaps with the guide burr 43 in the transverse direction 22.

For mechanical stabilization and for improved guidance, a support arch 55 is integrally formed on the disconnecting plate 38 and arches over the actual disconnecting plate 38. At its rim facing the fixed contact arm 5 (the right-hand rim shown in FIG. 16), the disconnecting plate 38 is provided with a fork-like guide projection 56, which engages in a form-fitting manner around the guide pin 42 in the fitted state. This guide projection 56 in this case at the same time acts as an abutment for the helical compression spring 51, via which the helical compression spring 51 introduces a spring force which prestresses the disconnecting plate 38 in the direction of its disconnected position. On the housing side, the helical compression spring 51, in the same way as the helical compression spring 37, is supported on the arm 24 of the housing base 3.

In the embodiment shown in FIGS. 16 to 24, the pushbutton 39 is guided on the fixed contact arm 5 only by the guide pin 41, which, for this purpose, protrudes into a corresponding opening in the pushbutton 39. The guide pin 42 and the helical compression spring 51 positioned thereon, on the other hand, extend in a cutout 57 (FIG. 19) in the pushbutton 39, without any direct interaction with said pushbutton.

At its rim facing the longitudinal protrusion 33 (the left-hand rim in the illustration shown in FIG. 16), an approximately L-shaped driver arm 58 is integrally formed on the disconnecting plate 38. This driver arm 58 engages behind the longitudinal protrusion 33 in the installed state and in the process bears tightly against the rear side of the longitudinal protrusion 33 (the side which is remote from the viewer in the illustration shown in FIG. 19). The disconnecting plate 38 is thus guided between the guide pin 42, the inner end 17 of the contact arm 5 and the longitudinal protrusion 33 of the bimetallic contact arm 6.

The interaction of the driver 54 with the guide burr 43 and the driver arm 58 is explained in more detail below with reference to FIGS. 21 to 23, which show the circuit breaker 1 in each case in a detail side view in different positions of the pushbutton 39 and the disconnecting plate 38 when the pushbutton 39 is depressed and then released.

Figure 21:
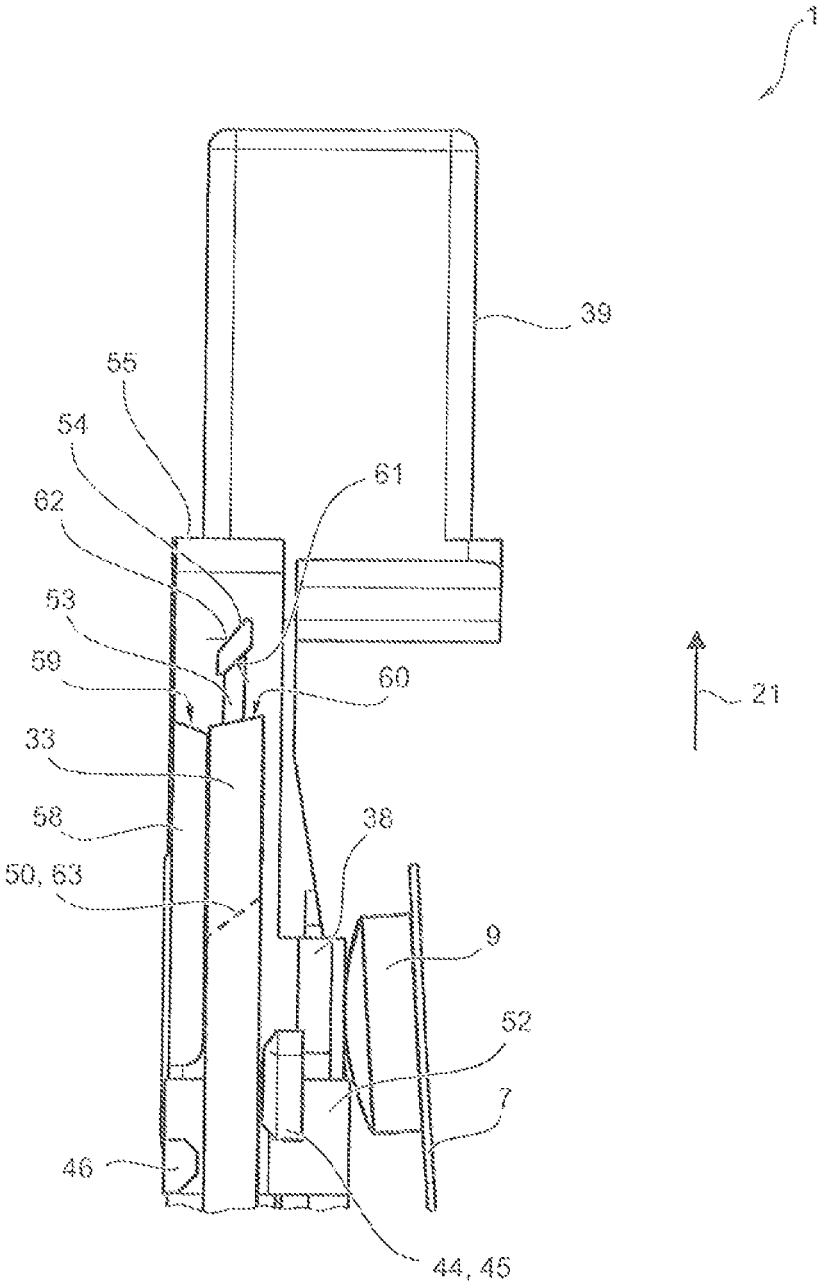
FIGS. 21 to 24 each show a side view of a detail of the circuit breaker shown in FIG. 16 in the fitted state without the housing cover in various positions of the disconnecting element during resetting of the circuit breaker.
Figure 22:
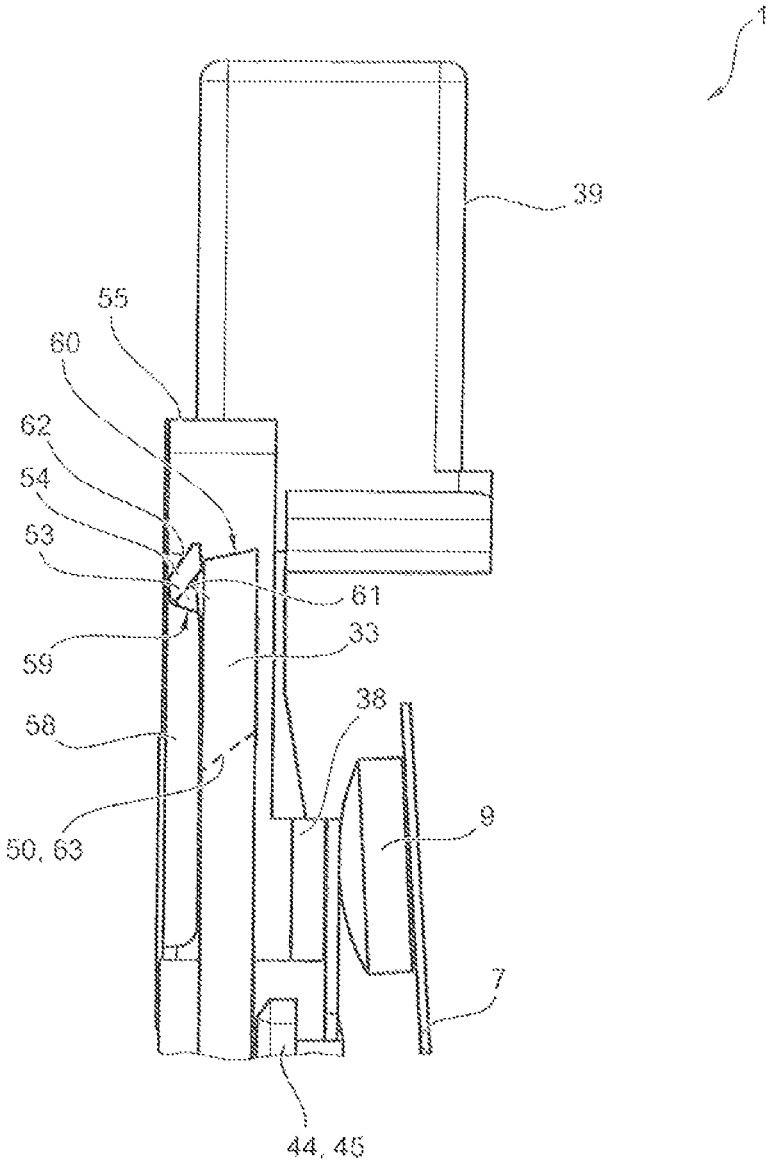

In this case, FIG. 21 first shows the circuit breaker 1 in the tripped state, wherein the pushbutton 39 is located in its extended position, and the disconnecting plate 38 is located in the disconnected position between the moving contact 9 and the fixed contact 8 (not shown here). In this state of the circuit breaker 1, the free end 59 of the driver arm 58 is aligned approximately with the free end 60 of the longitudinal protrusion 33. The driver 54, on the other hand, is arranged above the free end 60 of the longitudinal protrusion, as an extension of the plane defined by said longitudinal protrusion 33. The spring arm 53 therefore protrudes beyond the longitudinal protrusion 33 in this state. In this case, the spring arm 53 is located in the unstressed state (also referred to as the rest state).

As is shown in particular in FIGS. 21 to 24, the driver 54 has an approximately rhombic cross section. The surfaces 61 and 62 which point downward and upward, respectively, are in this case aligned at an angle to the longitudinal direction 21 and act as sliding slopes, on which the driver 54 is deflected by the guide burr 43.

When the pushbutton 39 is depressed, the driver 54 first strikes that upper edge of the longitudinal protrusion 33 which is formed on the free end 60. As a result of the angled position of the surface 61 and a corresponding sloping of the upper edge of the longitudinal protrusion 33, the driver 54 is deflected toward the rear side of the longitudinal protrusion 33 so as to cause the spring arm 53 to bend out. Here, it hits the free end 59 of the driver arm 54 and shifts said free end downward when the pushbutton 39 is depressed further (see FIG. 22). The disconnecting plate 38 is also shifted downward, in the direction toward its enable position, by the driver arm 58.

When the enable position is reached, the driver 54 enters the region of the notch 50 of the guide burr 43. The upper edge 63 of the notch 50 (not shown in the illustration shown in FIGS. 21 to 24) is indicated by dashed lines in these figures.

Figure 23:
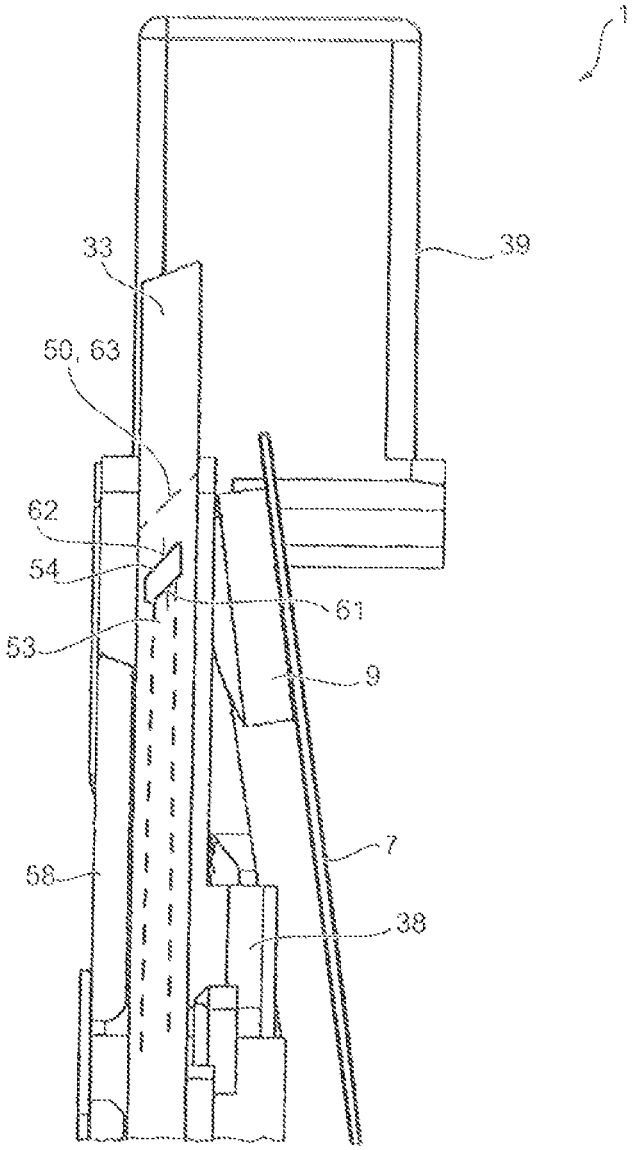

In the region of the notch 50, the driver 54 comes out of contact with the longitudinal protrusion 33, as a result of which the spring arm 53 snaps back into its rest position and the driver 54 again dips into the plane of the longitudinal protrusion 33 (the position of the driver 54 and the spring arm 53 is indicated by dashed lines in FIG. 23). The driver 54 is decoupled from the driver arm 58 by the driver 54 dipping into the notch 50. The disconnecting plate 38 which is thus no longer connected to the pushbutton 39 is thereupon shifted upward again under the pressure of the helical compression spring 51.

Figure 24:
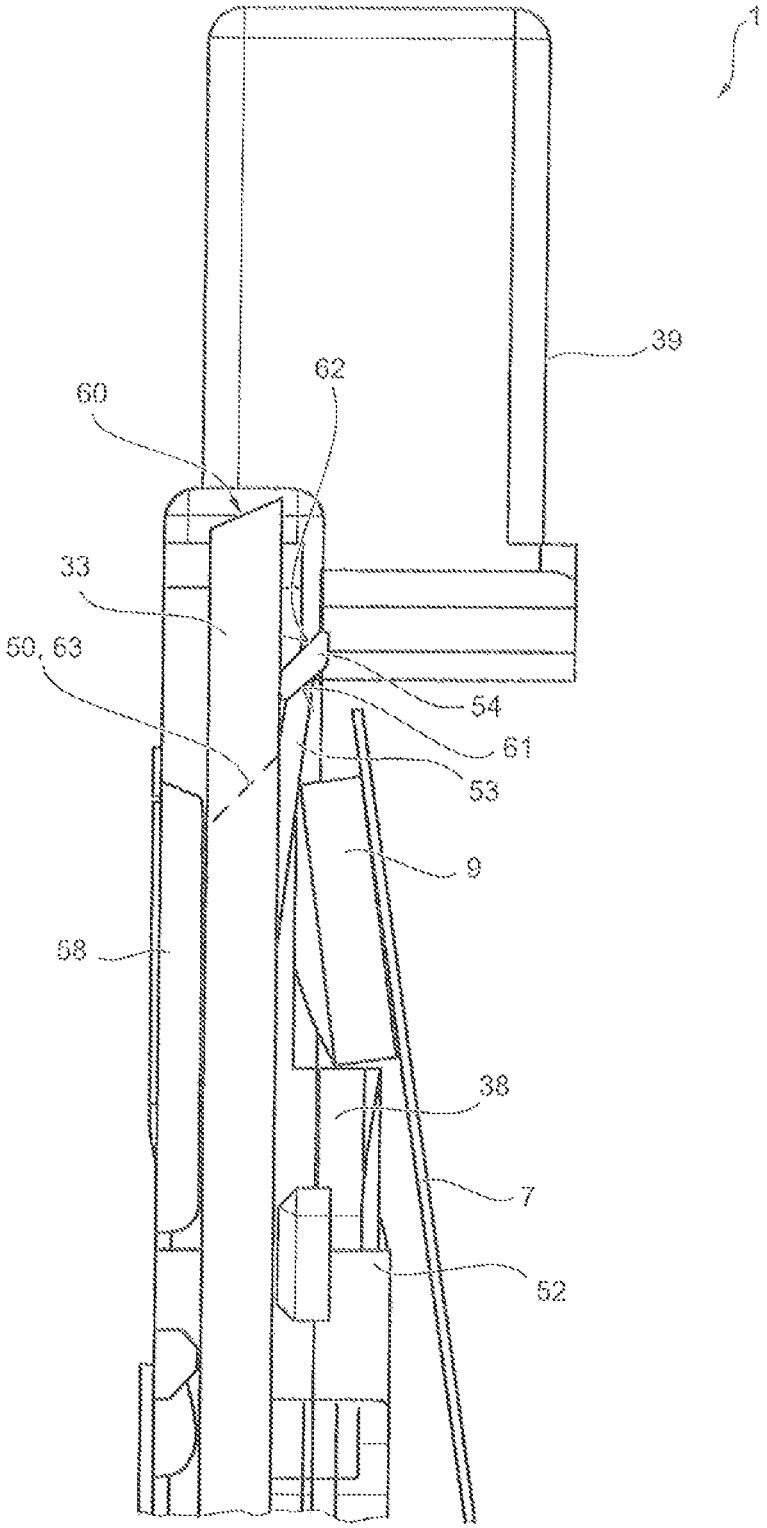

If the bimetallic snap-action disk 7 has at this point in time already cooled below its spring-back temperature, and the moving contact 9 therefore bears against the fixed contact 8 again, the disconnecting plate 38 stops against the moving contact 9, as in the above-described exemplary embodiment, as a result of which the disconnecting plate 38 is locked in its enable position (see FIG. 24).

If, on the other hand, the bimetallic snap-action disk 7 is still located in its tripped position, the disconnecting plate 38 is shifted into its disconnected position again under the pressure of the helical compression spring 51, to be precise even when the pushbutton 39 is still held in its depressed position.

When the pushbutton 9 is released, said pushbutton 9 is shifted upward in the direction toward its extended position by the spring pressure of the helical compression spring 37. The driver 54 in this case stops against the upper edge 63 with its upper surface 62. As a result of the angled position of the surface 62, and a corresponding angled position of the edge 63, the driver 54 is deflected toward the front side of the longitudinal protrusion 33 as the pushbutton 39 continues to be shifted so as to cause renewed bending of the spring arm 53. The driver 54 is thus shifted upward past the driver arm 58 and thus decoupled therefrom.

If, at this point in time, the disconnecting plate 38 is locked in its enable position on the moving contact 9, the path along which the pushbutton 39 is shifted is delimited by the disconnecting plate 38 by virtue of the pushbutton 39 stopping with the upper side of its transverse strut 52 against the lower edge of the disconnecting plate 38. The transverse strut 52 therefore forms a further driver, which locks the pushbutton 39 in its depressed position until the disconnecting plate 39 is located in its enable position.

If the disconnecting plate 38, on the other hand, is located in its disconnected position, the pushbutton 39 is shifted upward under the pressure of the helical compression spring 37 until it reaches its extended position, and therefore the initial position shown in FIG. 25 is again reached. The restoring operation of the circuit breaker 1 illustrated in FIGS. 21 to 23 can therefore be started again.

The invention claimed is:

1. A miniature circuit breaker, comprising:

a housing formed with a housing base of insulating material and a pot-shaped housing cover configured for placement on said housing base;

two flat, elongate contact arms partially embedded in said housing base and extending parallel to one another in a longitudinal direction thereof, said contact arms including a first contact arm having an inner end and a second contact arm having an inner end with a fastening point;

a fixed contact disposed at said inner end of said first contact arm;

a bimetallic snap-action disk with a moving contact at a free end thereof, said snap-action disk being mounted to said fastening point at said inner end of said second contact arm, said fastening point and said moving contact lying on an axis extending parallel to the longitudinal direction of said contact arms;

said inner end of said second contact arm being bent backwards between said housing base and said fastening point, about an axis extending transversely to the longitudinal direction of said contact arms, causing said inner end of said second contact arm to extend with an inclination relative to a central plane of the circuit breaker.

2. The circuit breaker according to claim 1, wherein said inner end of said second contact arm projects freely out of said housing base, causing said fastening point at which said bimetallic snap-action disk is attached to said inner end of said second contact arm to be spaced apart from said housing base.

3. The circuit breaker according to claim 2, wherein a distance between said fastening point and said housing base is at least 2 mm.

4. The circuit breaker according to claim 3, wherein the distance between said fastening point and said housing base is between 3 mm and 5 mm.

5. The circuit breaker according to claim 4, wherein the distance between said fastening point and said housing base is approximately 4.5 mm.

6. The circuit breaker according to claim 1, wherein each of said two contact arms has an outer end projecting outwardly from said housing base and forming a plug-type contact, and wherein a common axis of said fastening point and said moving contact runs approximately centrally between said outer ends of said contact arms.

7. The circuit breaker according to claim 1, wherein said two contact arms have outer ends projecting outwardly from said housing base and forming plug-type contacts, and said plug-type contacts together with said housing base being configured to be compatible with a female plug-type connector for a flat plug-type fuse according to ISO 8820 Type F.

8. The circuit breaker according to claim 1, which further comprises:

a disconnecting element for electrically disconnecting said moving contact from said fixed contact, said disconnecting element including a disconnecting plate formed of insulating material and a pushbutton protruding out of said housing cover in the fitted state;

said disconnecting element being movably guided for shifting between a disconnected position, in which said disconnecting plate is inserted between said moving contact and said fixed contact, and an enable position, in which said disconnecting plate enables contact to be made between said moving contact and said fixed contact; and a spring disposed to bias said disconnecting element towards the disconnected position, and wherein said disconnecting element is reset to the enable position by applying pressure to said pushbutton.

9. The circuit breaker according to claim 8, wherein said spring is a helical compression spring and wherein said spring is positioned on a first guide pin consisting of metal and extends at least substantially over an entire length of said spring.

10. The circuit breaker according to claim 9, wherein said guide pin is connected integrally to one of said contact arms.

11. The circuit breaker according to claim 9, wherein said guide pin protrudes into a guide bore formed in said disconnecting element.

12. The circuit breaker according to claim 9, wherein said guide pin protrudes into a guide bore formed in said pushbutton.

13. The circuit breaker according to claim 9, wherein said disconnecting plate of said disconnecting element is guided on a guide burr of said second contact arm.

14. The circuit breaker according to claim 13, wherein said disconnecting element has a forked guide contour engaging with a form-fit around said guide burr.

15. The circuit breaker according to claim 14, wherein said guide contour has two guide prongs offset with respect to one another in the longitudinal direction.

16. The circuit breaker according to claim 8, wherein said pushbutton and said disconnecting plate are formed as separate component parts and are guided to be shifted with respect to one another, wherein said pushbutton has a driver, guided so as to move said disconnecting plate into the enable position when said pushbutton is depressed out of an extended position into a depressed position, and such that, when the depressed position of the pushbutton is reached, said driver is decoupled from said disconnecting plate.

17. The circuit breaker according to claim 16, wherein said driver for coupling and decoupling with said disconnecting plate is guided on a closed circular path.

18. The circuit breaker according to claim 16, wherein said driver is guided around a guide burr formed integrally with one of said contact arms.

19. The circuit breaker according to claim 18, wherein said guide burr is integrally formed with said second contact arm.

20. The circuit breaker according to claim 16, wherein said driver has two sliding surfaces oriented at an angle with respect to the shifting direction of said pushbutton and arranged with respect to said second contact arm guiding the driver in such a way that the driver is deflected onto a flat side of said second contact arm when said pushbutton is depressed and deflected onto the respectively other flat side when said pushbutton is extended.

21. The circuit breaker according to claim 16, wherein said driver is connected to said pushbutton so as to be deflected elastically.

22. The circuit breaker according to claim 21, which comprises a spring arm integrally connecting said driver to said pushbutton.

23. The circuit breaker according to claim 16, wherein said driver is guided on one of said contact arms, when said pushbutton is depressed out of an extended position into a depressed position in the deflected state, and wherein said one of said contact arms is formed with a notch for decoupling said driver from said disconnecting plate, with said driver springing back into a rest position by virtue of said notch.

24. The circuit breaker according to claim 16, wherein said pushbutton has a second driver, which stops against said disconnecting plate in the extension direction of said pushbutton, such that said pushbutton is held in the depressed position as long as said disconnecting plate is located in the enable position.

25. The circuit breaker according to claim 16, wherein said disconnecting plate and said pushbutton are prestressed separately by in each case one separate helical compression spring which is positioned on in each case one separate guide pin of one of said contact arms, in a direction of the disconnected position or the extended position.

* * * * *